US009616682B2

(12) United States Patent
Akatsu et al.

(10) Patent No.: US 9,616,682 B2
(45) Date of Patent: Apr. 11, 2017

(54) PROCESS LIQUID COATING APPARATUS AND IMAGE FORMING SYSTEM

(71) Applicants: Kazuhiro Akatsu, Kanagawa (JP); Yutaka Nagasawa, Chiba (JP); Akitomo Kuwabara, Kanagawa (JP); Yuuji Ohmura, Kanagawa (JP); Hirofumi Ohkushi, Kanagawa (JP); Hirotaka Kobayashi, Kanagawa (JP); Sho Sawahata, Tokyo (JP)

(72) Inventors: Kazuhiro Akatsu, Kanagawa (JP); Yutaka Nagasawa, Chiba (JP); Akitomo Kuwabara, Kanagawa (JP); Yuuji Ohmura, Kanagawa (JP); Hirofumi Ohkushi, Kanagawa (JP); Hirotaka Kobayashi, Kanagawa (JP); Sho Sawahata, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/018,957

(22) Filed: Feb. 9, 2016

(65) Prior Publication Data

US 2016/0263913 A1 Sep. 15, 2016

(30) Foreign Application Priority Data

Mar. 12, 2015 (JP) ..... 2015-049941

(51) Int. Cl.
*B05C 1/08* (2006.01)
*B41J 11/00* (2006.01)
(Continued)

(52) U.S. Cl.
CPC ..... *B41J 11/0015* (2013.01); *B05C 1/0813* (2013.01); *B65H 23/1888* (2013.01);
(Continued)

(58) Field of Classification Search
CPC ..... B41J 11/0015; B41J 11/16; B41F 13/03; B41F 13/06; B41F 25/00; B05C 1/083; B05C 1/12; B05C 1/0813
See application file for complete search history.

(56) References Cited

U.S. PATENT DOCUMENTS

2014/0253652 A1* 9/2014 Ohba ..... B41J 11/0015 347/101
2015/0210091 A1 7/2015 Hoshina et al.
2015/0210887 A1* 7/2015 Alfekri, Jr. ..... B41M 5/502 524/432

FOREIGN PATENT DOCUMENTS

JP 2014-024224 2/2014
JP 2014-058118 4/2014

* cited by examiner

*Primary Examiner* — Julian Huffman
*Assistant Examiner* — Sharon A Polk
(74) *Attorney, Agent, or Firm* — IPUSA, PLLC

(57) ABSTRACT

There is provided a process liquid coating apparatus comprising: a recording medium conveyance unit configured to convey a recording medium; a coating roller configured to rotate in accordance with the conveyed recording medium to apply process liquid on a surface of the recording medium; a pressure roller configured to cause the coating roller to apply the process liquid on the surface of the recording medium by forming an abutment part for nipping and pressing the recording medium with the coating roller; and a winding member configured to form a bent conveyance path along which the recording medium is bent with respect to a conveyance direction so that the recording medium is wound around the surface of the pressure roller, wherein the winding member is disposed adjacent to the pressure roller.

8 Claims, 19 Drawing Sheets

(51) Int. Cl.

| | |
|---|---|
| ***B65H 23/188*** | (2006.01) |
| *B05C 9/04* | (2006.01) |
| *B05C 9/12* | (2006.01) |
| *B05C 9/14* | (2006.01) |

(52) U.S. Cl.
CPC ..... *B05C 1/083* (2013.01); *B05C 9/04* (2013.01); *B05C 9/12* (2013.01); *B05C 9/14* (2013.01)

PROCESS LIQUID COATING APPARATUS AND IMAGE FORMING SYSTEM

BACKGROUND OF THE INVENTION

1. Field of the Invention

The present disclosure relates to process liquid coating apparatuses and image forming systems for coating a recording medium with a process liquid.

2. Description of the Related Art

Among methods for recoding images by inkjet, there is a method in which process liquid for aggregating ink is applied to a sheet serving as a recording medium just before the ink droplet adheres to the sheet, thereby improving image quality.

A method for applying the process liquid is known, in which entire sheet surface is coated with the process liquid by using a roller. In FIG. 19, an example configuration of a coating unit, which is an example of a coating apparatus for coating the sheet with the process liquid by using the roller, is shown. In FIG. 19, "W" indicates a recording medium such as a paper sheet, 90 indicates a process liquid coating unit, 91 indicates a chamber for the coating liquid, "L" indicates process liquid, 92 indicates a squeeze roller, 93 indicates coating roller, and 94 indicates pressure roller. In the example, the process liquid L is pumped up through rotation of the squeeze roller 92 driven by a motor. The process liquid L pumped up by the squeeze roller 92 is scrapped off by a nip of the coating roller 93 and the squeeze roller 92 whose edge portions are covered with elastic body such as gum elastic, whereas the remained coating liquid is thinly and uniformly drawn out on a surface of the coating roller 93. The process liquid L drawn out on the coating roller 93 is transferred to a sheet caught in a coating nip N configured by the pressure roller 94 and the coating roller 93 (for example, Patent Document 1).

In the above described liquid coating apparatus for inkjet printer, in a case where the liquid is applied to continuous paper such as continuous roll of paper, different paper sagging may occur in sheet width direction due to variance of sheet (recording medium) property or thickness in sheet width direction. In FIG. 20, waviness W1 indicates a shape of the recording medium W at an upstream side of the coating nip N, where wave shape is formed due to the variance of thickness in sheet width direction, or the like. In a case where the waviness W1 is formed in the recording medium W, the waviness W1 of the recording medium W is pressed in the coating nip N nipping the recording medium W by the coating roller 93 and the pressure roller 94 to form wrinkle W2. The wrinkle W2 downstream of the coating nip N indicates a shape of the recording medium W after being pressed by the coating nip N.

Generally, it is known that wrinkling can be suppressed by causing a large tension of the sheet in the coating operation to suppress the paper sagging. However, tension of the sheet cannot be enlarged so much due to a condition of the device, and the like. Also, the large tension cannot be applied to some types of the sheet (e.g. thin or light sheet) due to a lack of paper strength. Therefore, occurrence of wrinkles due to variance of paper properties cannot be prevented by controlling only the tension.

In FIG. 21, another example configuration of the coating unit 90A is shown as an example of conventional technology (Patent Document 2). In the aforementioned configuration, an application amount of liquid to the sheet W is adjusted by winding the sheet around the coating roller 93 by using the winding unit 95. However, also in the aforementioned configuration, the occurrence of wrinkles cannot be perfectly prevented because the waviness W1 of the recording medium W is pressed in the coating nip N to form the wrinkle W2 in a case where the waviness W1 is formed upstream of the coating nip N as shown in FIG. 20.

RELATED ART DOCUMENT

Patent Document

[Patent Document 1]: Japanese Unexamined Patent Application Publication No. 2014-024224

[Patent Document 2]: Japanese Unexamined Patent Application Publication No. 2014-058118

SUMMARY OF THE INVENTION

An object of disclosure of the present technology is to provide a coating apparatus with which wrinkling of the recording medium occurring at abutment part of the coating roller and the pressure roller is unlikely to occur even when the conveyed recording medium differently sags in sheet width direction.

The following configuration is adopted to achieve the aforementioned object.

In one aspect of the embodiment, there is provided a process liquid coating apparatus comprising: a recording medium conveyance unit configured to convey a recording medium; a coating roller configured to rotate in accordance with the conveyed recording medium to apply process liquid on a surface of the recording medium; a pressure roller configured to cause the coating roller to apply the process liquid on the surface of the recording medium by forming an abutment part for nipping and pressing the recording medium with the coating roller; and a winding member configured to form a bent conveyance path along which the recording medium is bent with respect to a conveyance direction so that the recording medium is wound around the surface of the pressure roller, wherein the winding member is disposed adjacent to the pressure roller.

Other objects, features and advantages of the present invention will become apparent from the following detailed description when read in conjunction with the accompanying drawings.

DETAILED DESCRIPTION OF THE PREFERRED EMBODIMENTS

Figure 1:
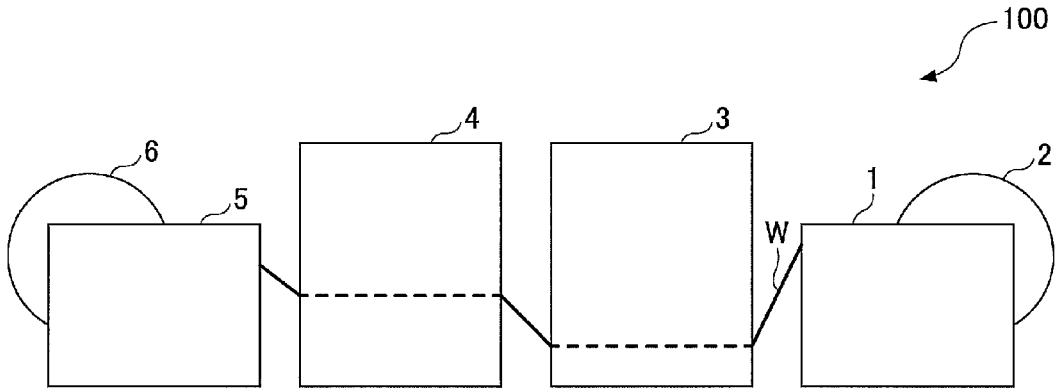
FIG. 1 is a diagram illustrating an example configuration of a first embodiment.

In the following, embodiments will be described with reference to accompanying drawings. FIG. 1 is a diagram illustrating an example configuration of a first embodiment. FIG. 1 schematically illustrates a part of an inkjet image forming system (inkjet printing system) 100 of the present embodiment.

As shown in FIG. 1, a recording medium (a medium on which an image is formed (web paper)) W formed by a continuous paper, etc., fed from a feeding roll 2 of a feeding device 1 is sent in a pretreatment apparatus 3 including a coating apparatus 33 and 34. The pretreatment apparatus 3 applies process liquid (pretreatment liquid) having a function for aggregating ink of the adhered ink droplet to an image forming surface of the recording medium W, where the process liquid serves as a coating material. The process liquid may be applied to one surface of the recording medium or both surfaces thereof in accordance with desired printed material.

Then, the recording medium W is sent into an inkjet printer (recording apparatus) 4 disposed downstream of the pretreatment apparatus in a conveyance direction of the recording medium W. In the recording apparatus 4, the ink droplets are ejected on the surface of the recording medium W on which the pretreatment liquid has been applied, thereby forming a desired image. The recording apparatus 4 may include a first inkjet printer, a second inkjet printer and an inversion device. When double-side printing is performed, the inversion device inverts a front surface and a back surface of the recording medium W after an image is formed on the front surface by the first inkjet printer, and the recording medium W is sent into the second inkjet printer to eject the ink droplet on the back surface of the recording medium W, thereby forming the desired image.

After forming the image as described above, the recording medium W is sent into an after-treatment apparatus 5 in which a certain after-treatment process is performed. Then, as shown in FIG. 1, a winding roll 6 winds the recording medium W after performing the after-treatment process. Additionally, after performing the after-treatment process, the recording medium W may be folded or cut instead of being wound.

Figure 2:
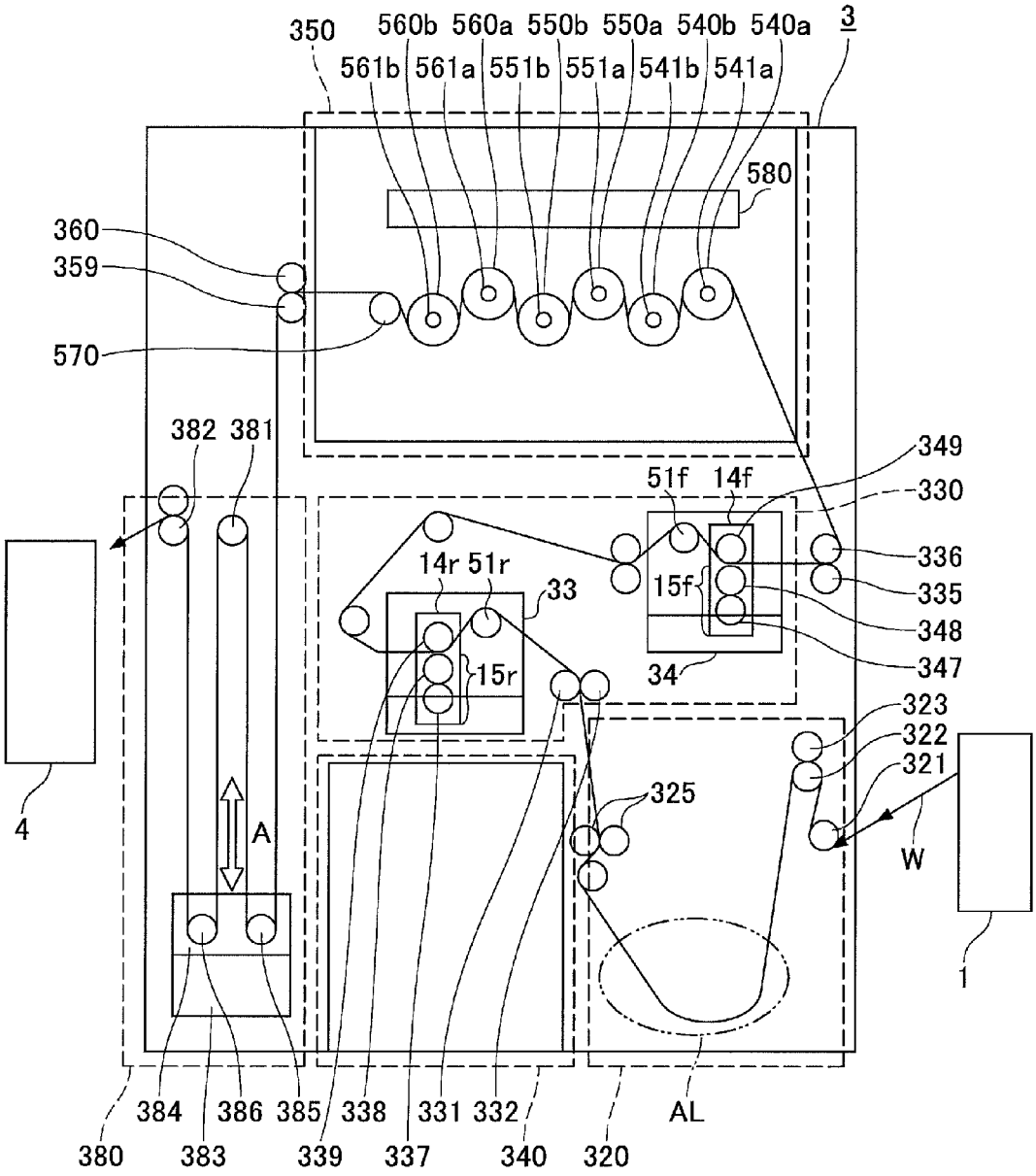
FIG. 2 is a diagram schematically illustrating an example configuration of a pretreatment liquid coating and drying apparatus used in an image forming system of the present embodiment.

FIG. 2 is a diagram schematically illustrating an example configuration of the pretreatment apparatus (pretreatment liquid coating and drying apparatus) 3 used in the image forming system 100.

In the following, the pretreatment apparatus 3 will be described with reference to FIG. 2. The pretreatment apparatus 3 includes a pretreatment liquid coating unit (process liquid coating drying device) 330 including coating mechanisms 33 and 34 for applying the pretreatment liquid to the recording medium W. A heating unit (recording medium heating device) 350 for drying the pretreatment liquid of the recording medium W is disposed downstream of the pretreatment liquid coating unit 330 in the conveyance direction of the recording medium.

The pretreatment apparatus 3 further includes an air loop unit 320, a pretreatment liquid supplying unit 340 and a dancer unit 380.

The air loop unit 320 includes a rotatably supported guide roller 321, a feed-in (FI) roller 322 and a FI nip roller 323 for nipping and conveying the recording medium W. In the air loop unit 320, the guide roller 321, the self-rotating FI roller 322 and the FI nip roller 323 rotate according to the FI roller 322 and convey the recording medium W fed from the feeding device 1 to send the recording medium W into the air loop unit 320. At this time, rotation of the FI roller 322 is controlled with an optical sensor (not shown) so that an air loop AL with which the recording medium W is loosened at a certain loosening amount. Upon the recording medium W passing through the air loop AL, tension for stabilizing the conveyance is applied to the recording medium W by a tension shaft (not shown), and the recording medium W is sent into the pretreatment liquid coating unit 330.

Upon passing through the air loop AL, the recording medium W is conveyed between two edge guides and between two path shafts 325 whose longitudinal direction is orthogonal to the conveyance direction (direction shown by an arrow) of the recording medium W, where the recording medium forms "S" shape in the aforementioned conveyance path. The two path shafts 325 are supported by edge guides, and a distance between the edge guides is approximate the same as the width of the recording medium W. Additionally, the edge guides are fixed at the path shafts 325 by using fixing means such as clinchers. The distance between the edge guides is adjusted in accordance with the width of the recording medium W. According to the path shafts and the edge guides, conveyance position in the width direction of the recording medium W is controlled so as to stabilize the conveyance. Upon passing through the path shafts 325 and the edge guides, the tension for stabilizing the conveyance is applied to the recording medium W by the fixed tension shaft.

Figure 3:
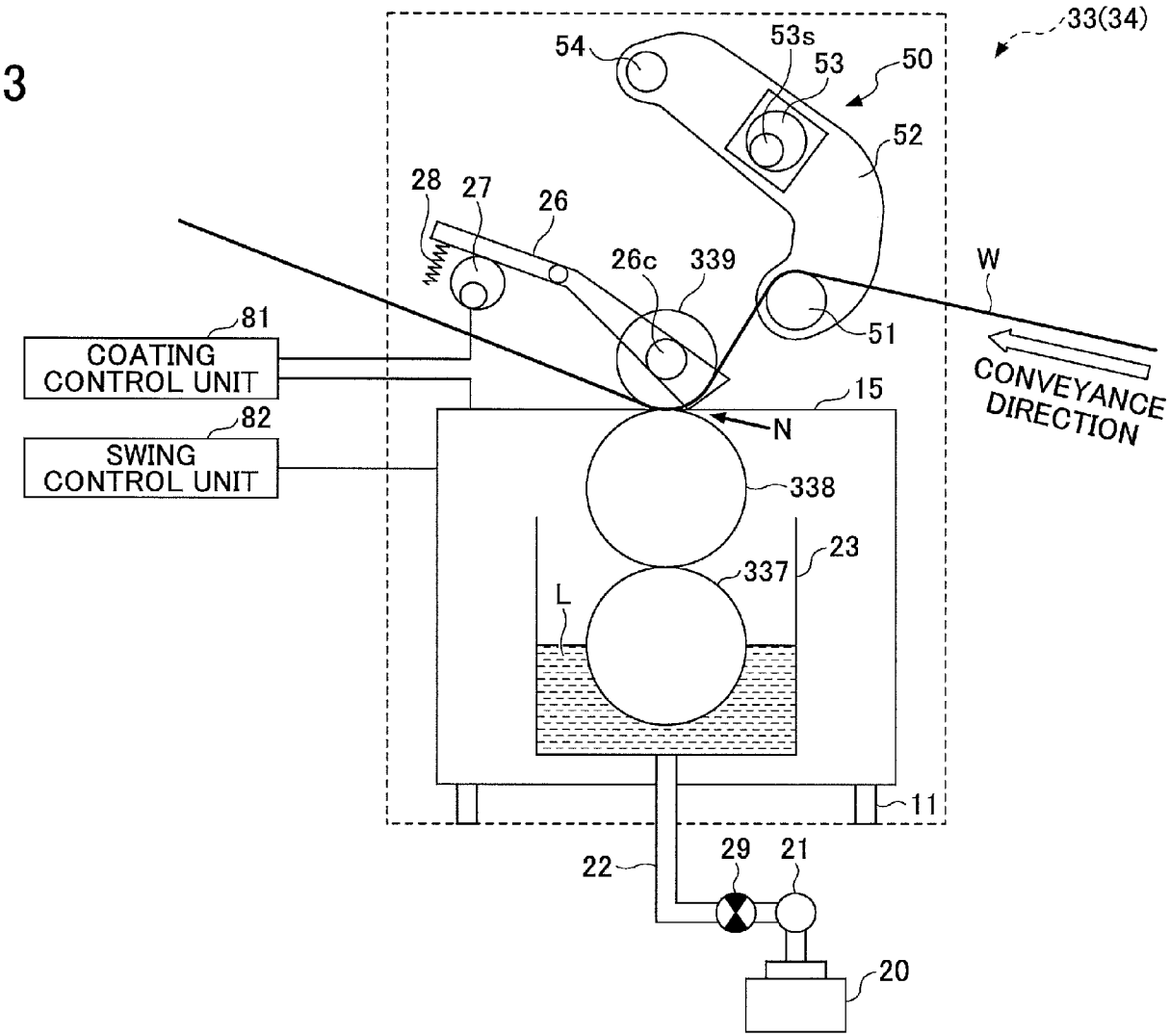
FIG. 3 is a cross sectional view of an example configuration of a coating mechanism of a first embodiment.

The pretreatment liquid coating unit 330 includes a self-rotating in-feed roller 331, a feed nip roller 332, a back surface coating mechanism 33 and a front surface coating mechanism 34. Further, the pretreatment liquid coating unit 330 includes a coating control unit 81 for controlling the back surface coating mechanism 33 and the front surface coating mechanism 34 and a swing control unit 82, which are shown in FIG. 3. A self-rotating out-feed roller 335 and a feed nip roller 336 are disposed adjacent to the pretreatment liquid coating unit 330.

The feed nip roller 332 and the in-feed 331 nip and convey the recording medium W, and feed nip roller 336 and the out-feed roller 335 nip and convey the recording medium W. The in-feed roller 331 and the feed nip roller 332 serve as a conveyance unit.

The back surface coating mechanism (coating apparatus) 33 includes a squeeze roller 337 and a coating roller 338, a pressure roller 339 and a winding roller 51*r*. When the recording medium W sent into the back surface coating mechanism 33 is nipped and conveyed by the coating roller 338 and the pressure roller 339, the pretreatment liquid is applied to one surface (back surface) of the recording medium W by the coating roller 338 to which the pretreatment liquid is supplied from the squeeze roller 337. The pressure roller 339 is included in a pressure unit 14*r* and the squeeze roller 337 and the coating roller 338 are included in the coating unit 15*r*. Upon passing through the back surface coating mechanism 33, the recording medium W is sent into the front surface coating mechanism 34.

The front surface coating mechanism (coating apparatus) 34 includes a squeeze roller 347, a coating roller 348, a pressure roller 349 and a winding roller 51*f*, and the front surface coating mechanism 34 applies the pretreatment liquid to the other surface (front surface) of the recording medium W. The pressure roller 349 is included in a pressure unit 14*f*, and the squeeze roller 347 and the coating roller 348 are included in a coating unit 15*f*. Upon passing through the front surface coating mechanism 34, the recording medium W is sent into the heating unit 350 that is a heating device, where the recording medium W is conveyed by the out-feed roller 335 and the feed nip roller 336.

Additionally, the back surface coating mechanism 33 and the front surface coating mechanism 34 are controlled so as to selectively operate. The pretreatment liquid is applied to one or both of the front surface and the back surface of the recording medium W.

The pretreatment liquid supplying unit 340 retains the pretreatment liquid therein, and supplies the pretreatment liquid to the back surface coating mechanism 33 and the front surface coating mechanism 34 as necessary.

The heating unit 350 includes heated rollers 540*a*, 540*b*, 550*a*, 550*b*, 560*a*, and 560*b* arranged in the aforementioned order from upstream side of the conveyance direction of the recording medium W. The heating unit 350 further includes an ejection conveyance roller 570 and a control device 580. In the heating unit 350, a control process is performed by the control device 580 to control heating amounts of respective heaters 541*a*-561*b* of the respective heated rollers 540*a*-560*b*.

The recording medium W is sequentially fed through the respective heated rollers 540*a*-560*b* forming a zigzag shape, while the out-feed roller 335 and the feed nip roller 336, and the feed roller 359 and the feed nip roller 360 convey the recording medium W in the heating unit 350. The respective heated rollers 540*a*-560*b* are rotated according to the conveyed recording medium W, thereby heating the recording medium W to dry the pretreatment liquid coated on the recording medium W.

As described above, the respective heated rollers 540*a*-560*b* are rotated according to the conveyed recording medium W. Therefore, for example a motor, etc., is not required to rotate the respective heated rollers, which enables downsizing of the heating unit 350 as space for a motor, etc., is not required.

Once the front surface of the recording medium W coated with the pretreatment liquid is dried in the heating unit 350, the recording medium W is nipped and conveyed by the self-rotating feed roller 359 and the feed nip roller 360 to be sent into the dancer unit 380.

Additionally, the heating unit 350 may be omitted in a case where dry versions of the coating liquid and the recording medium are used, or in a case where there is need to reduce the space for the pretreatment apparatus 3. In this case, upon being ejected from the back surface coating mechanism 33 and the front surface coating mechanism 34, the recording medium W is directly sent into the dancer unit 380.

The dancer unit 380 includes two guide rollers 381 and 382, a movable frame 384, a position detection unit (not shown) for detecting a position of the movable frame 384, two dancer rollers 385 and 386 rotatably attached to the movable frame 384. The movable frame 384 is provided so as to be movable with the dancer rollers 385 and 386 in a direction shown as an arrow A, where a weight 383 is provided at lower portion of the movable frame 384. The recording medium W is conveyed through the two guide rollers 381 and 382 and two dancer rollers 385 and 386, where the recording medium W forms a "W" shape in the aforementioned rollers.

The dancer unit 380 controls a conveyance amount of the feed roller 359 based on an output from the position detection unit, and thereby adjusts the position of the movable frame 384 in a vertical direction (up and down direction). Buffer of the recording medium W between the pretreatment apparatus 3 and the recording apparatus 4 disposed downstream is secured by adjusting the position of the movable frame 384.

The recording medium W heated in the heating unit 350 is cooled in the dancer unit 380, and then the recording medium W is sent into the recording apparatus 4 disposed downstream.

According to the configuration described above, the pretreatment apparatus 3 applies the pretreatment liquid to the recording medium W to send the same into the recording apparatus 4 disposed downstream. When the pretreatment apparatus 3 applies the pretreatment liquid to the recording medium W, ink bleeding, change of color density and color tone, offsetting, etc., can be prevented, and the quality of image can be improved due to permeation assistance.

First Embodiment

Figure 4:
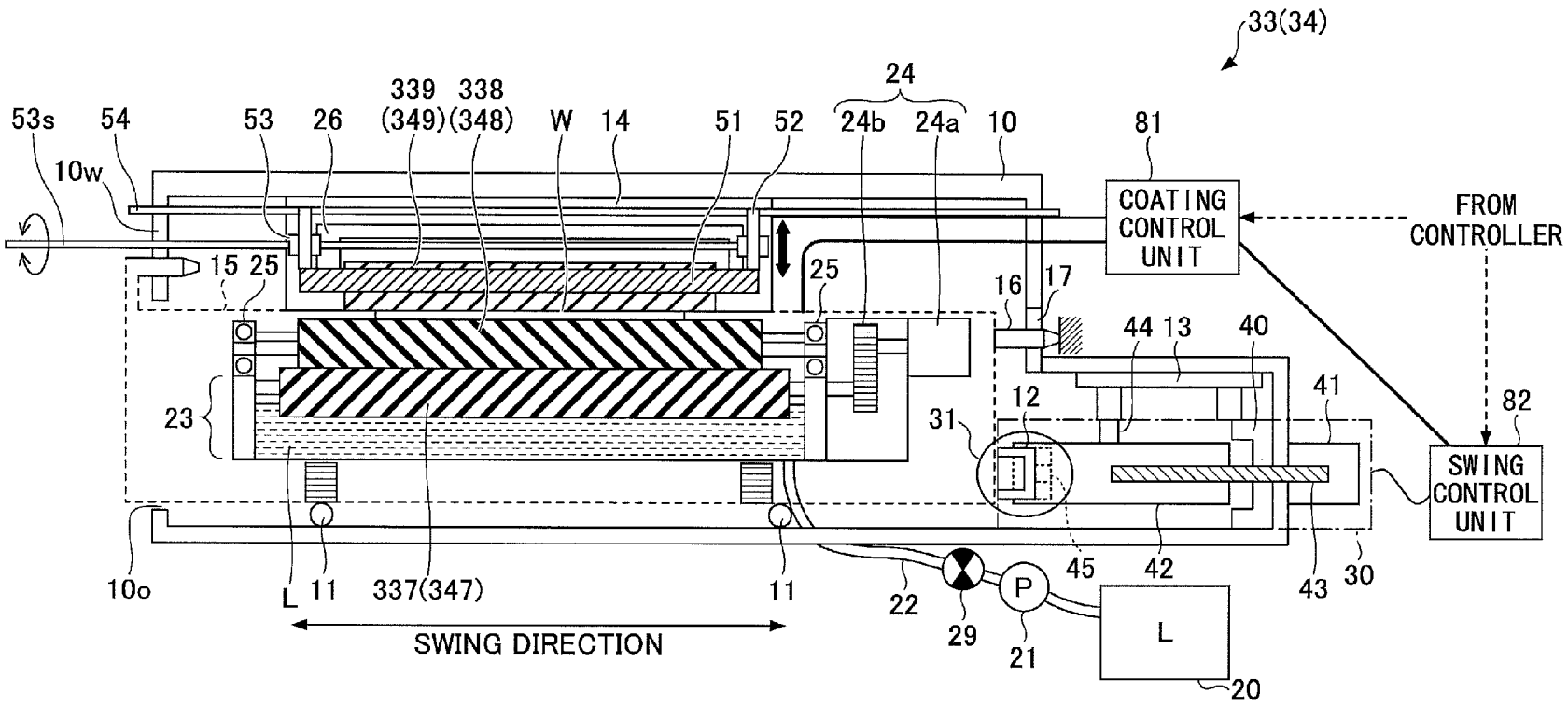
FIG. 4 is a cross sectional view of the example configuration of the coating mechanism shown in FIG. 3 viewed from another direction.

FIG. 3 is a cross sectional view schematically illustrating an example configuration of the coating mechanism 33 of the present embodiment viewed in a roller axis direction. FIG. 4 is a cross sectional view illustrating the example configuration of the coating mechanism 33 shown in FIG. 3 viewed in a direction orthogonal to the roller axis direction. Additionally, the back surface coating mechanism 33 and the front surface coating mechanism 34 shown in FIG. 2, which have the same configurations, are included in the coating mechanism 33. Therefore, in the following, the back surface coating mechanism 33 will be described as an example. Also, in the coating mechanism 33 and 34, respective configurations of the pressure units 14*r* and 14*f*, respective configurations of the coating units 15*r* and 15*f*, and respective configurations of the winding rollers 51*r* and 51*f* are the same. Therefore, the references may be omitted in the descriptions below.

The coating mechanism 33 includes the pressure unit 14, the coating unit 15 and a moving mechanism 30 serving as a swing mechanism (swing unit). Also, a coating control unit 81 and a swing control unit 82 are coupled to the coating mechanism 33. Further, a pretreatment liquid supplying unit (cartridge) 340 is coupled to the coating unit (process liquid chamber) 15 of the coating mechanism 33.

The squeeze roller 337 and the coating roller 338, and peripheral members thereof are mounted on the coating unit 15, while the pressure roller 339 and peripheral members thereof are mounted on the pressure unit 14. The coating control unit 81 receives an instruction of an operation related to printing from a controller (not shown) in the image forming system 100 to control the members in the coating unit 15 of the coating mechanism 33 and members in the pressure unit 14, and thereby controls the amount of the pretreatment liquid that is applied.

The process liquid L retained in the pretreatment liquid supplying unit 340 is supplied to a supply pan 23 of the coating unit 15 through a supply path 22 and an electromagnetic valve 29, where the process liquid L is transferred by a pump 21, which is an electrically driven liquid transfer unit, such as a tubing pump and diaphragm pump.

The process liquid L retained in the supply pan 23 is pumped up through rotation of the squeeze roller 337, which is rotated by a coating amount adjusting motor 24*a* included in the motor unit 24 through a gear 24*b*. For example, when the squeeze roller 337 is formed by an anilox roller, a wire bar, etc., whose surface includes groves, the amount of the process liquid L pumped up is unlikely to change even if a viscosity of the process liquid or a printing speed changes.

Here, the anilox roller is a metal roller used for printing, paper manufacturing, etc., and fine grooves are formed on a surface of thereof. Various shapes of the grooves are formed such as triangular shaped grooves, and pyramid shaped grooves. When using a conventional roller whose surface does not include the grooves, the amount of liquid pumped up becomes unstable due to the printing speed, the viscosity of the process liquid, and the like. On the other hand, when using the anilox roller, the amount of liquid that is pumped up is increased and stabilized due to the grooves thereof, even if viscosity of the process liquid or the printing speed is changed.

The wire bar formed by winding wires with various thicknesses around a metal roller may be used. However, the wires may loosen in the wire bar. Hence, the anilox roller, which is formed by forming the grooves directly on the metal roller, is preferable for use as the squeeze roller 337.

A part of the process liquid L pumped up by the squeeze roller 337 is scrapped off by a abutment part of (coating amount adjusting nip) of the coating roller 338 and the squeeze roller 337 whose edge portions are covered with elastic body such as gum elastic, whereas the remained process liquid L is thinly and uniformly drawn out on a surface of the coating roller 338.

At this time, an amount of the process liquid L can be controlled by changing a load of the coating amount adjusting nip of the coating roller 338 and the squeeze roller 337. The process liquid L drawn out on the surface of the coating roller 338 is applied to the recording medium W nipped by the pressure roller 339 and the coating roller 338.

Both ends of the coating roller 338 are supported by bearings 25, and the coating roller 338 rotates when the recording medium W moves, that is, the coating roller 338 rotates according to the conveyance of the recording medium W. In a case where the friction resistance between the coating roller 338 and the recording medium W is low due to a large coating amount, the recording medium W slips on the coating roller 338, and an abrasion of the coating roller 338 occurs at a portion contacting the edge portion of the recording medium W.

Additionally, in the pressure unit 14, arms 26 serving as an elevating mechanism are disposed at both ends of the pressure roller 339. As shown in FIG. 3, a tension spring 28 is coupled to an end of the arm 26 opposite to the other end at which a rotation axis 26*c* is formed. An eccentric cam (eccentric cam for pressure roller) 27 is disposed adjacent to the tension spring 28. In applying the liquid, the pressure roller 339 is elastically pushed against the coating roller 338 by the elevating mechanism using the principle of leverage.

When application of the process liquid L is not required, the pressure roller is lifted to release the contact between the pressure roller 339 and the coating roller 338 (coating nip N). At this time, the pressure roller 339 is moved to separate from the coating roller 338, where the pressure roller is moved against an elastic force of the tension spring 28 through rotation of the eccentric cam 27, which is disposed between the pressure roller 339 and the tension spring 28, and contacts the arm 26.

The pressure unit 14 including the pressure roller 339 is detachably fixed at housing 10. That is, the pressure roller 339 is disposed in a manner such that the position of the pressure roller can be moved in the housing 10.

The coating unit 15, serving as a process liquid chamber, retains the process liquid therein, and the coating roller 338 and the squeeze roller 337 are rotatably fixed in the coating unit 15. Also, the coating unit 15 is provided in a manner such that the coating unit 15 can move (swing) in the width direction of the recording medium W (direction orthogonal to the conveyance direction of the recording medium W) in the housing 10.

A part of the moving mechanism 30, the pressure unit 14 and the coating unit 15 are included in the housing unit 10. The coating unit 15 is detachable with respect to the housing 10 that is a main body.

In the present embodiment, the housing 10 includes an opening at a lower left portion in FIG. 4. When attaching the coating unit 15 to the coating mechanism 33, the coating unit 15 is horizontally (see arrow shown in FIG. 4) inserted from the opening 10*o* of the housing 10. As the coating unit 15 is inserted to a certain extent, two positioning pins 16 are inserted in holes formed at respective positions upstream and downstream of a positioning plate 17 provided in the housing 10, thereby positioning the coating unit 15 in the conveyance direction (depth direction in space of FIG. 4) of the recording medium W.

Also, the coating unit 15 is positioned in the width direction (left and right direction in FIG. 4) of the recording medium W when a latch pin (engagement member) 12 of the coating unit 15 engages with a latch 45 of the moving mechanism 30. At this time, the moving mechanism 30 continuously or intermittently swings (moves) the coating unit 15 in a direction orthogonal to the conveyance direction of the recording medium W, where the coating unit 15 is coupled to the moving mechanism 30 through the latch pin 12 and includes wheels 11 at a bottom thereof. The coating unit 15 can move because the wheels 11 rotate on a bottom of the housing 10 (or rail provided at bottom of housing) according to a force of the moving mechanism 30.

The moving mechanism 30 is indicated as a portion surrounded by the chain line in FIG. 4. The moving mechanism 30 includes a slider 42 that is a moving member, the latch 45 and a position detection target 44 respectively provided on the slider 42, a screw shaft 43, a frame 40 disposed in the housing 10, and a motor (swing motor) 41 disposed outside of the housing 10. A latch mechanism 31 is indicated as a portion of a circle shown in FIG. 4. The latch mechanism 31 includes the latch 45 disposed on the slider 42 engaging with the latch pin 12 of the coating unit 15, and the like.

As the motor 41, fixed to the housing 10, drives to have the screw shaft (screw axis) 43 rotate, the slider 42 horizontally (in a width direction of the recording medium W) slides along the screw shaft 43. The coating unit 15, coupled to the slider 42 through the latch pin 12 and the latch 45, is swung by having the slider 42 move back-and-forth as described above. That is, when the slider (moving member) 42 coupled to the coating unit 15 (process liquid chamber) moves, the coating unit 15 moves in the housing 10, thereby swinging the coating roller 338 disposed in the coating unit 15 in the width direction of the recording medium W with respect to the pressure roller 339.

A position sensor 13 detects a position of the moving mechanism 30, where the position sensor 13 includes a plurality of sensors such as photo interrupters disposed adjacent to the moving mechanism 30. More specifically, the movement range of the moving mechanism 30 is predetermined because a swing range of the coating unit 15 is defined as a range in which the coating unit 15 is moved in the width direction of the recording medium W. The position sensor 13 outputs the detection result when it detects that the moving mechanism 30 has reached one end of the movement range. Upon the position sensor 13 outputting the detection result, the moving mechanism 30 is controlled to move in an opposite direction.

Further, for example, the position sensor 13 detects a position of the position detection target 44 in the moving mechanism 30 when printing ends, and outputs the detection result to an IC chip (described below) serving as a storage unit. The detected position is retrieved to be used at starting the next printing.

The position sensor 13 includes a plurality of sensors arrayed in the moving direction of the moving mechanism 30, where the sensors at both ends of the array respectively detect that the moving mechanism 30 has reached the end of the moving range. Also, at finishing the printing, the position sensor 13 detects the position of the moving mechanism 30 by determining which sensor from among the sensors is nearest, or between which sensors the position is detected. Further, as shown in FIG. 4, the position detection target 44 used for detecting the position of the slider 42 may be provided on the slider 42 that is a moving member in the moving mechanism 30. Although one position detection target 44 is shown in FIG. 4, a plurality of position detection targets 44 may be provided.

The swing control unit 82 coupled to the moving mechanism 30 is coupled to a coating control unit 81 or a controller (not shown) of the image forming apparatus 100. The swing control unit 82 controls a moving direction, a moving speed and driving time of the slider 42 of the moving mechanism 30 based on information indicating a coating amount determined based on a type of paper and a resolution, printing speed, the detected position of the moving mechanism 30, and the like.

Additionally, an IC chip (not shown) is included in the coating unit 15, and a position (moving position) of the coating roller 338 at finishing the previous printing and the swing direction (moving direction) of the coating roller 338 are stored in the IC chip. The position and the swing direction are retrieved from the IC chip to start the next printing with the retrieved position and the swing direction. By performing the above-described processes, an abrasion amount can be averaged within the swing range.

As described above, when the recording medium W is conveyed between the pressure roller 339 and the coating roller 338, the process liquid (coating liquid) L on the surface of the coating roller 338 is applied to the recording medium W, where the coating liquid L is supplied from the rotating squeeze roller 337 to the coating roller 338. The recording medium W coated with the process liquid is sent from the back surface coating mechanism 33 into the heating unit 350 through the front surface coating mechanism 34, where the recording medium W is swung in the back surface coating mechanism 33 while the coating liquid is coated thereon.

In the above described coating mechanism 33, in a case where the recording medium W differently sags in the width direction due to variance of property or thickness in the width direction of the recording medium W, the waviness of the recording medium W are seen. For example, in a case where the property of the sheet (winding state or thickness of sheet) varies in width direction due to a damage caused in transportation or manufacture of the sheet, moisture adsorption of the sheet, etc., the waviness is likely to be seen.

Also, when performing the aforementioned swing, the pressure roller 339 moves with respect to the coating roller 338 in the coating nip N. Therefore, tension in the width direction is caused in the recording medium W due to the movement of the coating roller 338, while it is assumed that a portion of the recording medium W at which the tension is not applied sags to cause the waviness. Also, in the swing motion, because the coating roller 338 moves back-and-forth horizontally (in width direction of the sheet), the tension is applied to the recording medium W in a reverse direction when the coating roller reaches an end of the swing range. Therefore, as time passes, the recording medium W may sag in different directions.

In a case where the recording medium W sagging as described above is continuously conveyed, pressing of the waviness of the recording medium W at the coating nip N results in the formation of wrinkles, where the coating nip N is the abutment part of the coating roller 338 and the pressure roller 339 for nipping and pressing the recording medium W.

Therefore, in the present embodiment, a winding roller is disposed upstream of the coating nip N in the conveyance direction of the recording medium W to bend the conveyance path of the recording medium W. According to the above-described configuration, the recording medium W is pressed against the winding roller and a specified tension is applied thereto, thereby restraining the recording medium W to eliminate various wavy deformations of the recording medium W caused by sagging due to external environment or transportation. Hence, the waviness due to the sagging can be reduced and occurrence of the wrinkling can be suppressed. In the following, the winding roller will be described.

<Winding Roller>

In the present embodiment shown in FIG. 3 and FIG. 4, the coating mechanism 33 includes a winding roller 51 of the winding unit 50 for winding the recording medium W around the pressure roller 339. The winding roller 51 is disposed upstream of the pressure roller 339 in the conveyance direction of the recording medium W.

By disposing the winding roller (winding member) 51 adjacent to the pressure roller 339, a bent conveyance path is formed so that the recording medium W is bent with respect to the conveyance direction so as to be wound around the pressure roller 339.

According to the aforementioned configuration, after the recording medium passes through the winding roller 51 at upstream side and is wound around the pressure roller 339, the recording medium W passes through the coating nip N including the coating roller 338 on which the process liquid L is applied whereby the process liquid L is applied to the recording medium W.

In the winding unit 50 of the present embodiment, both ends of the winding roller 51 are fixed at arm shaped supporting members 52. A pivot 54 is formed at an end of the supporting member 52 opposite to the other end at which the winding roller 51 is fixed. An eccentric cam (winding eccentric cam) 53 is disposed between the winding roller 51 and the pivot 54.

As shown in FIG. 4, the pivot 54 is fixed at the housing 10 penetrating the housing 10 of the coating mechanism 33. An axis 53*s* of the eccentric cam 53 is fixed projecting out from one side wall 10*w* of the housing 10 of the coating mechanism 33. The axis 53*s* of the eccentric cam 53 is rotatably fixed at the wall 10*w* of the housing 10.

When the axis 53*s* of the eccentric cam 53, projected from the wall 10*w* of the housing 10, is manually rotated, the eccentric cam 53 being in contact with the supporting member 52 eccentrically rotates, thereby revolving the supporting member 52 around the pivot 54. Thus, the position of the winding roller 51, which is fixed at the end of the supporting member 52, can be moved. As described above, the supporting member 52 can adjust the position of the winding roller 51 with respect to the pressure roller 339. Consequently, a winding angle of the recording medium W with respect to the pressure roller 339 can be adjusted.

Figure 5A:
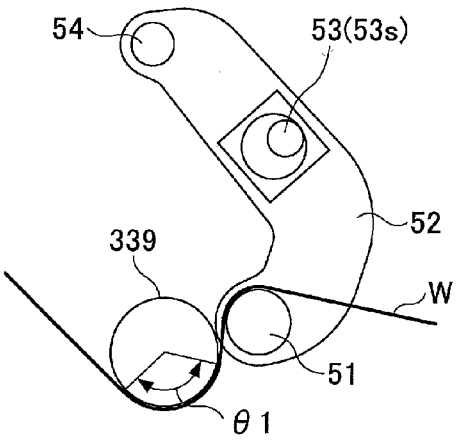
FIG. 5A is a diagram illustrating a winding state with a large winding angle.
Figure 5B:
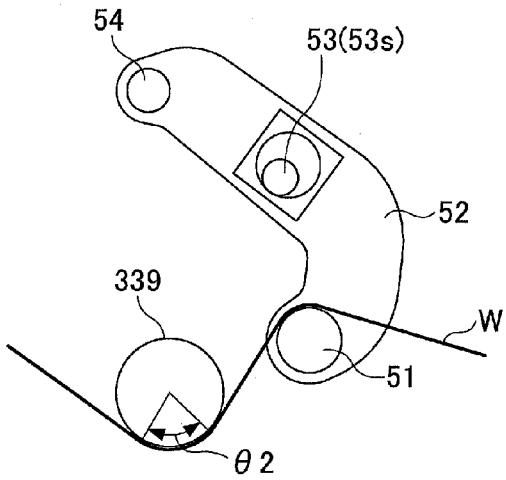
FIG. 5B is a diagram illustrating a winding state with a small winding angle.

Adjustment of the winding state of the recording medium around the pressure roller 339 by the winding unit 50 is shown in FIG. 5A and FIG. 5B. FIG. 5A is a diagram illustrating the winding state with a large winding angle θ1. FIG. 5B is a diagram illustrating the winding state with a small winding angle θ2. A transition from the state shown in FIG. 5A into the state shown in FIG. 5B is achieved by manually rotating the axis 53*s* of the eccentric cam 53, projecting out from the wall 10*w* of the housing 10, to eccentrically rotate the eccentric cam 53 so as to move the position of the winding roller 51, as described above. Additionally, as shown in FIG. 5A and FIG. 5B, the winding angle is a central angle corresponding to the contact arc of the pressure roller 339, wherein the contact arc is a portion that contacts the recording medium W within a circular surface of a cross-section the pressure roller 339.

Figure 6:
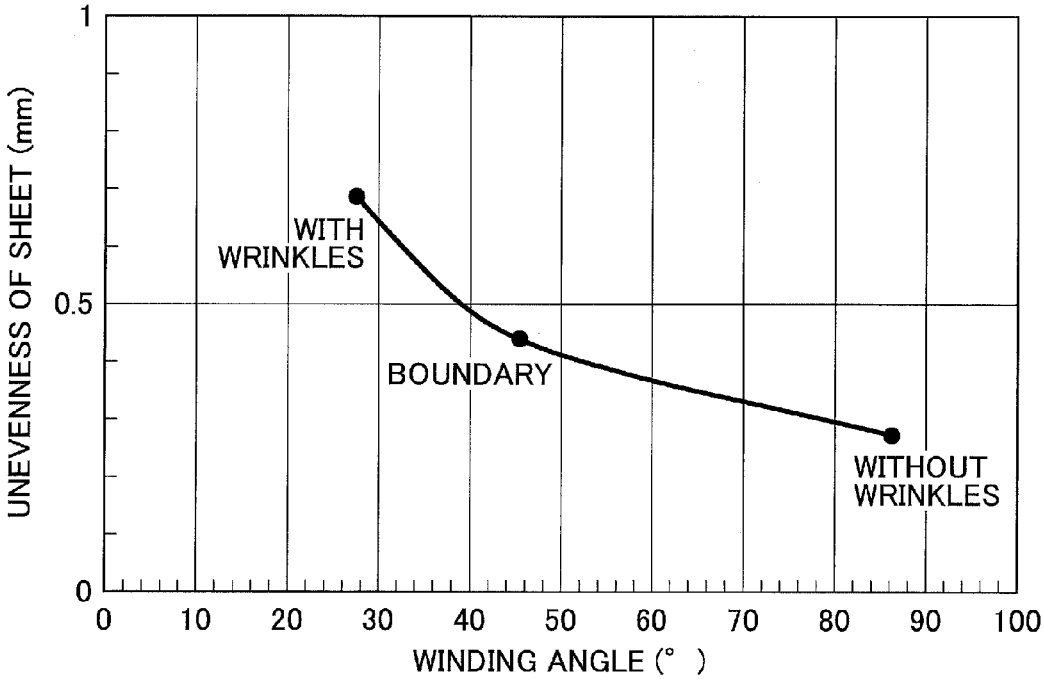
FIG. 6 is a diagram illustrating a measurement result of unevenness of the recording medium W, where the winding angle is changed.

FIG. 6 is a diagram for illustrating a measurement result of unevenness of the recording medium W after the recording medium W is pressed in the coating nip N of the pressure roller 339 and the coating roller 338, where the winding angle is changed by moving the position of the winding roller 51 in the configuration shown in FIG. 3. Wherein, a common sheet whose having a basis weight of 128 g/m$^2$ that is a sheet (e.g., sheet for long time storage and possibly absorbing humidity) likely to include wrinkles due to the variance of the sheet property or thickness in the width direction is used as the recording medium W.

According to an experiment, in which the aforementioned measurement and surveillance of a relationship between the occurrence of wrinkling and unevenness of the sheet were performed, it was found that an amount of the unevenness of the sheet changes when the winding angle of the sheet wound around the pressure roller 339 is changed. Further, in the case of the sheet used in the measurement of FIG. 6, wrinkling occurs when the unevenness of the sheet is greater than or equal to 0.45 mm while wrinkling does not occur when the unevenness of the sheet is less than 0.45 mm.

Thus, in the case of the sheet used in the measurement of FIG. 6, it can be found that unevenness of the sheet needs to be less than 0.45 mm and the winding angle needs to be greater than or equal to 45° so as to prevent the occurrence of the wrinkles.

That is, in the case of the sheet used in the measurement of FIG. 6, the occurrence of wrinkles can be prevented by controlling the position of the winding roller 51 so that the winding angle of the sheet wound around the pressure roller 339 is greater than or equal to 45°. If the winding angle is further increased, the occurrence of wrinkling can be prevented even if a sheet having a variance of the sheet property or thickness in the width direction greater than those of the sheet used in the measurement of FIG. 6 is used. Also, wrinkles are likely to occur in a case where a large tension cannot be applied to the sheet. However, according to the configuration of the present embodiment, the occurrence of the wrinkles can be prevented by bending the conveyance path even if a large tension cannot be applied to the sheet.

In the present embodiment, when the pretreatment liquid is applied during printing, the winding angle is not adjusted, but instead remains fixed at a large angle with which the occurrence of wrinkles can be prevented.

However, in a case where the winding angle is large, charging operation of the recording medium W due to paper jam or role replacement becomes difficult because the distance between the pressure roller 339 and the winding roller 51 becomes short. Therefore, as shown in FIG. 5B, in the charging operation of the recording medium W, the winding angle is reduced to separate the winding roller 51 from the pressure roller 339. After charging the recording medium W, as shown in FIG. 5A, the winding roller 51 is manually moved to a position closer to the pressure roller 339, thereby increasing the winding angle.

Figure 20:
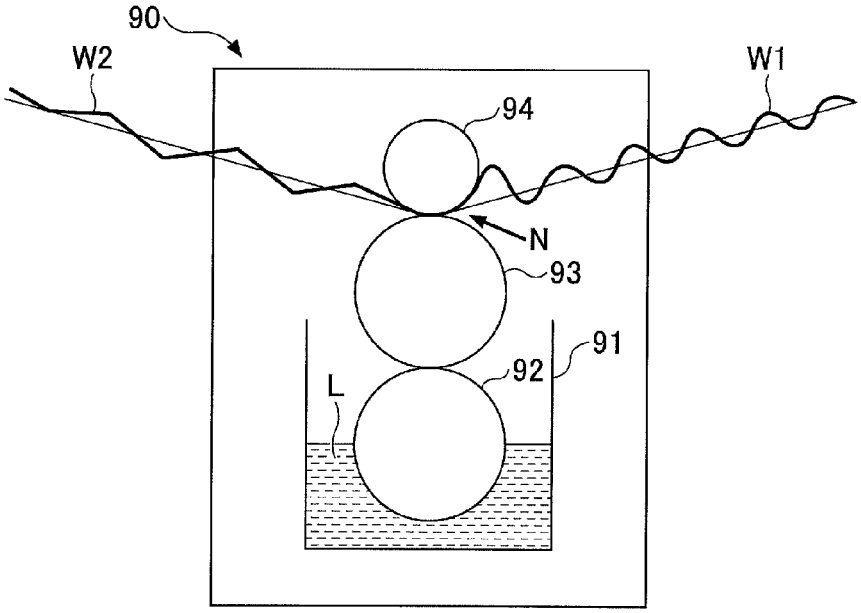
FIG. 20 is a diagram illustrating wrinkles in FIG. 19.
Figure 21:
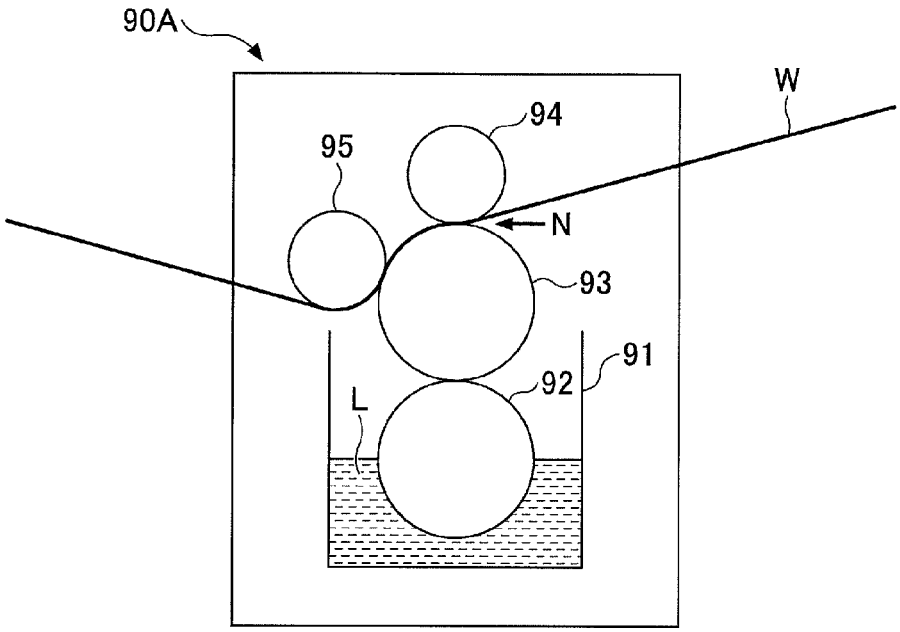
FIG. 21 is a diagram schematically illustrating another example conventional process liquid coating unit.

When the winding roller 51 of the present embodiment is provided, the recording medium W is wound around the pressure roller 339. Therefore, the waviness of the recording medium can be eliminated or reduced to suppress the occurrence of wrinkling, because the wavy deformation can be resolved by bending the conveyance path with the winding roller 51 even if the waviness W1 occurs upstream of the coating nip N as shown in FIG. 20.

Additionally, although a similar effect can be expected when the recording medium W is wound around the coating roller 338, in this case, the coating amount is changed according to the winding state or state of the waviness because the recording medium W is wound just after being coated. The coating amount should remain constant in the apparatus of the present embodiment. The present embodiment, in which the waviness is reduced by bending the conveyance path just before the coating operation, is more preferable in comparison to the configuration in which the recording medium is wound around the coating roller 338 to prevent the occurrence of wrinkling, because the coating amount is unlikely to be kept constant with the configuration.

As described above, by disposing the winding roller 51 upstream of the pressure roller 339 in the conveyance direction of the recording medium W to bend the conveyance path of the recording medium W, the recording medium W is pressed against the winding roller 51 and a prescribed tension is applied thereto, thereby re-straining the recording medium W to eliminate various wavy deformations caused by sagging due to external environment or transportation. Hence, the waviness of the recording medium W upstream of the coating nip N can be reduced and the occurrence of the wrinkling downstream of the coating nip N can be suppressed.

Additionally, the aforementioned effect can be obtained when the winding roller 51 is a rotating roller or a rod shaped member that does not rotate. However, the rotating roller is preferable because the conveyance of sheet is easier with a rotating roller.

Second Embodiment

Figure 7:
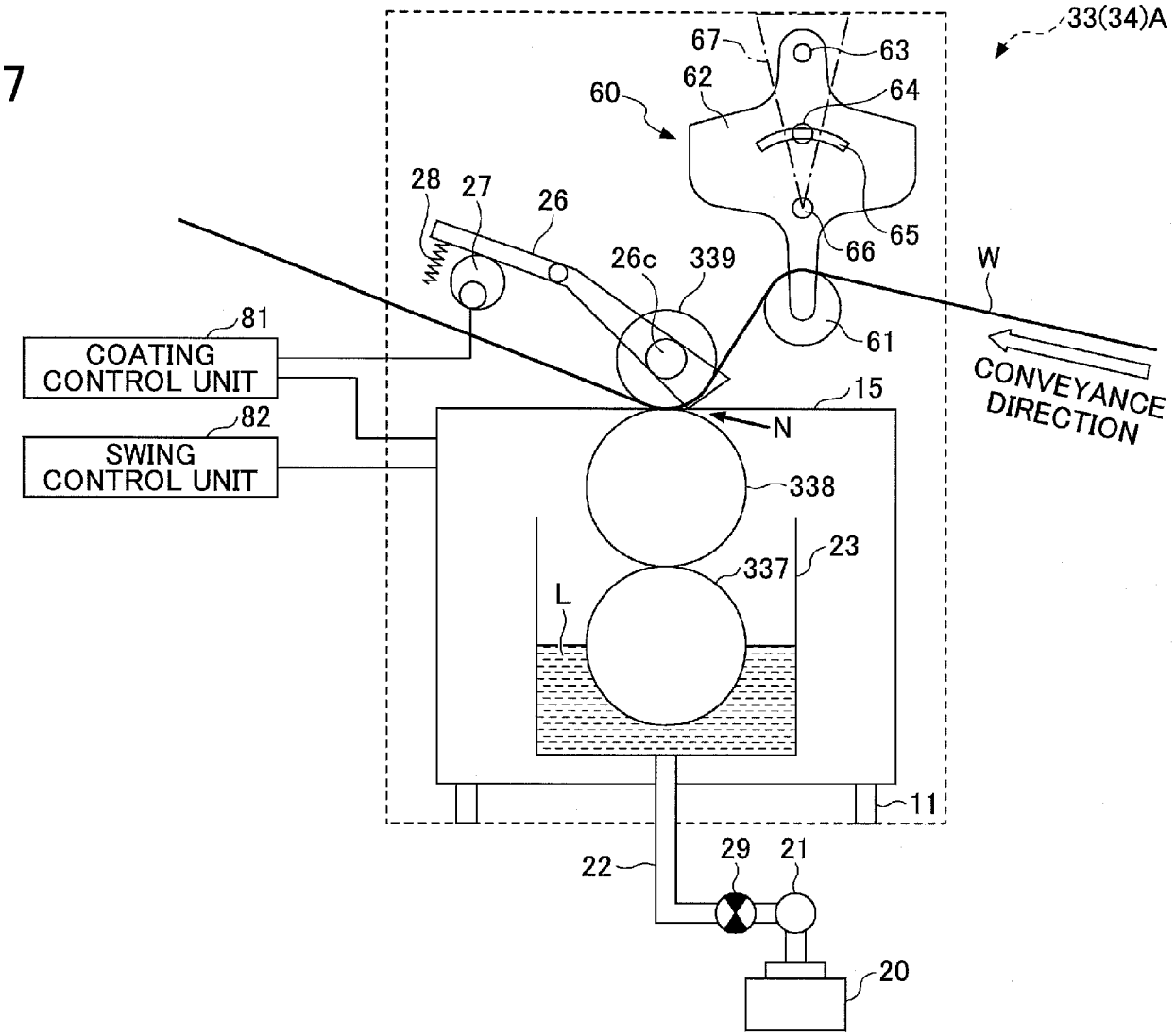
FIG. 7 is a cross sectional view of an example configuration of the coating mechanism of a second embodiment.
Figure 8:
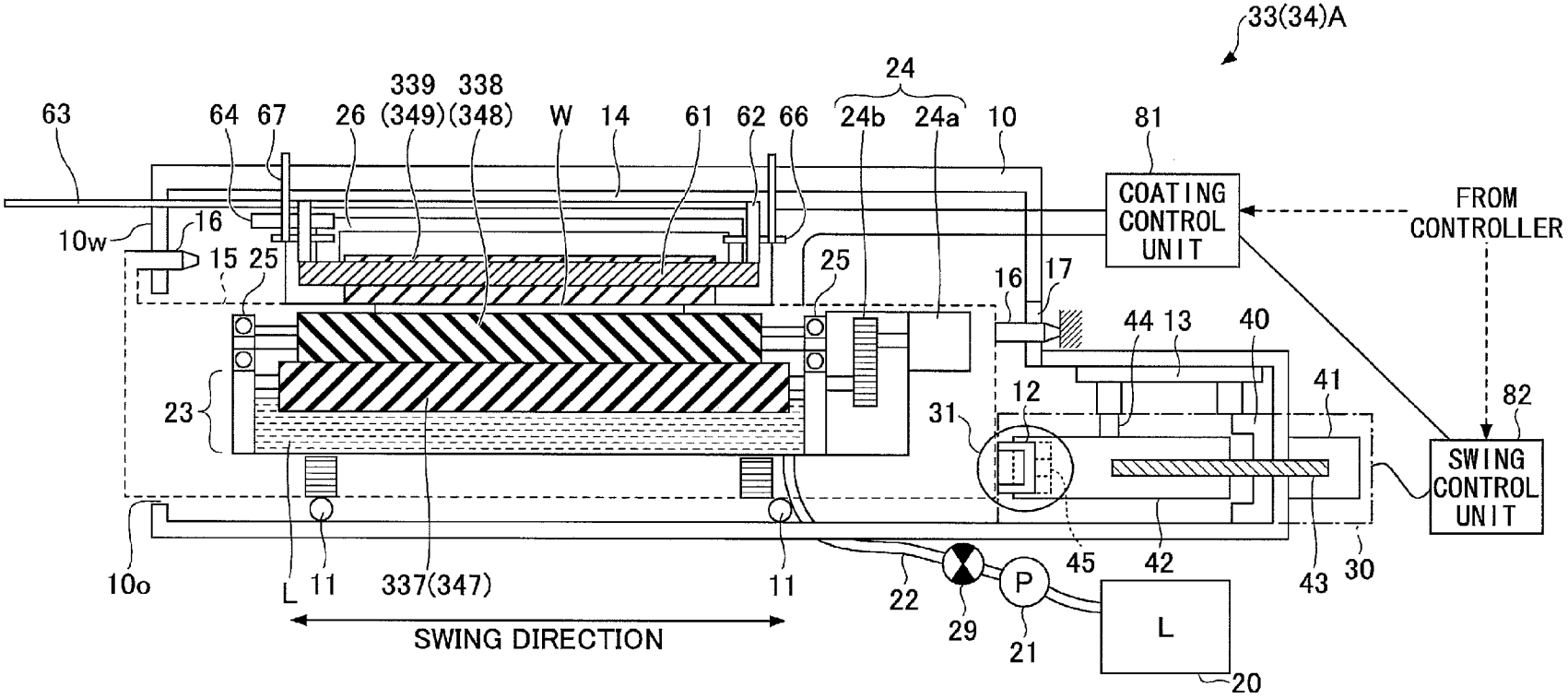
FIG. 8 is a cross sectional view of the example configuration of the coating mechanism shown in FIG. 7 viewed from another direction.
Figure 9A:
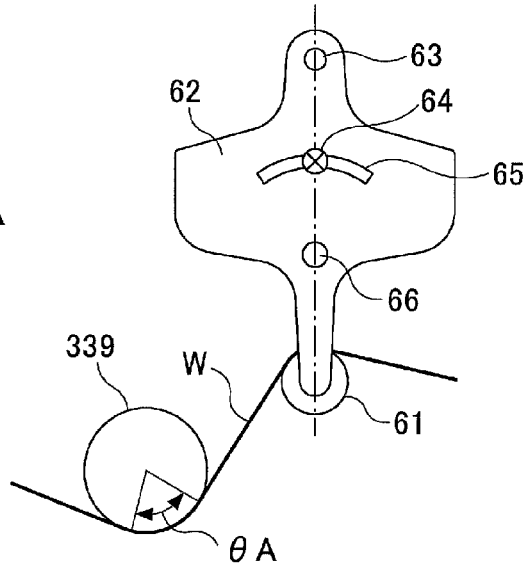
FIG. 9A is a diagram illustrating adjustment of winding state of the pressure roller.
Figure 9B:
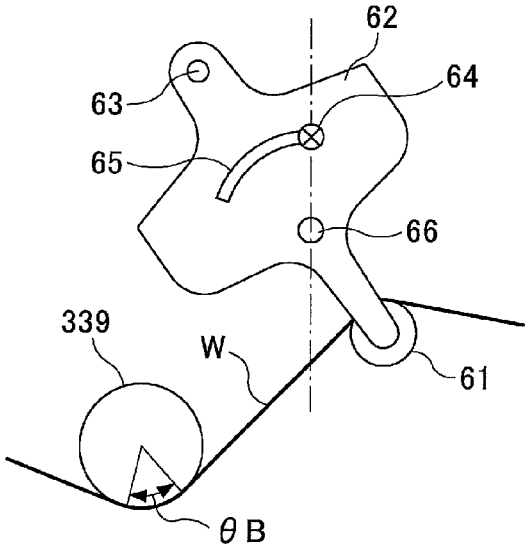
FIG. 9B is another diagram illustrating the adjustment of winding state.
Figure 9C:
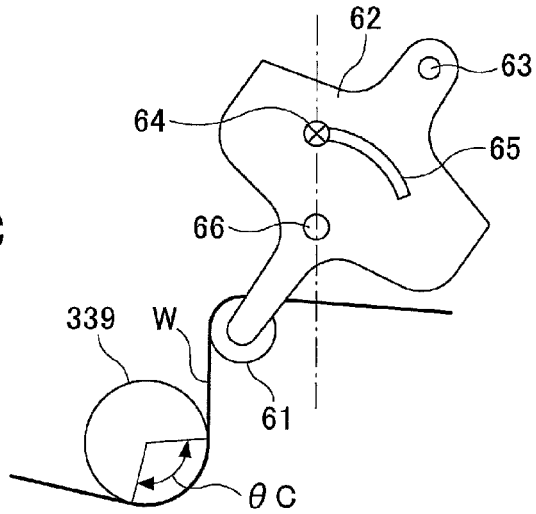
FIG. 9C is another diagram illustrating the adjustment of winding state.

FIG. 7 is a cross sectional view of an example configuration of the coating mechanism 33A of the second embodiment viewed in a roller axis direction. FIG. 8 is a cross sectional view of the example configuration of the coating mechanism 33A shown in FIG. 7 viewed in a direction orthogonal to the roller axis direction. FIG. 9A-FIG. 9C are diagrams illustrating an operation of a winding unit 60 of the present embodiment.

In the winding unit 60 of the present embodiment shown in FIG. 7, both ends of the winding roller 61 are fixed at supporting members 62. An axis (handle) is formed at an end of the supporting member 62 opposite to the other end at which the winding roller 61 is fixed. An elongated hole 65 is formed between the winding roller 61 and the axis 63. In the supporting member 62, a pivot pin 66 is disposed between the winding roller 61 and the elongated hole 65, and a screw 64 is disposed being contact with the elongated hole 65.

As shown in FIG. 8, the axis 63 projects out from one side wall 10*w* of the housing 10 of the coating mechanism 33. The axis 63 serving as a handle is used for securing the strength, and movably projects out from the wall 10*w* of the housing 10.

The pivot pin 66 is coupled to a fixing member 67. The fixing member 67 is coupled to the housing 10 at two points in upper side to fix the pivot pin 66 of the supporting member 62. The screw 64 fixes the elongated hole 65 of the supporting member 62 so that the supporting member 62 is in a desired pivot state. In view of operability, the screw 64 may be disposed only at front side of the housing (left side in FIG. 8).

FIG. 9A-FIG. 9C show the adjustment of the winding state of the pressure roller 339 by the winding unit 60. FIG. 9A is a diagram illustrating the adjustment of winding state of the pressure roller 339, where the winding angle θA is approximately 70°.

FIG. 9B is a diagram illustrating the adjustment of winding state of the pressure roller 339, where the winding angle θA decreases from the state shown in FIG. 9A. In FIG. 9B, the supporting member 62 is fixed by the screw 64 so that the position of the upstream winding roller 61 is more separate from the pressure roller 339 in comparison to a position of the winding roller 61 shown in FIG. 9A. In FIG. 9B, the winding angle θB is approximately 55°.

FIG. 9C is a diagram illustrating the adjustment of winding state of the pressure roller 339, where the winding angle increases from the state shown in FIG. 9B. In FIG. 9C, the supporting member 62 is fixed by the screw 64 so that a position of the upstream winding roller 61 is closer to the pressure roller 339 in comparison to the position of the winding roller 61 shown in FIG. 9B. In FIG. 9C, the winding angle θC is approximately 105°.

As described above, an area of a portion in which the recording medium W contacts the winding roller 61 increases as the winding angle increases. Therefore, when the winding angle increases, the wrinkles can be reduced by re-straining (applying tension again to) the recording medium W in broader area even if the wrinkles remain after contacting with the winding roller 61.

Thus, in the aforementioned configuration, the winding angle can be flexibly set. Transitions between the respective states shown in FIG. 9A-FIG. 9C are achieved by manually moving the axis 63 projecting out from the wall 10*w* to change the state of the supporting member 62 and to move the position of the winding roller 61.

In the present embodiment, similarly to the first embodiment, when performing application operation of the pretreatment liquid during printing, the winding angle is not adjusted, rather it is fixed at a large angle with which the occurrence of wrinkles can be prevented. That is, as shown in FIG. 9B, when the recording medium is charged, the winding angle is manually decreased so that the position of the winding roller 61 is separated from the position of the pressure roller 339. After charging the recording medium W, as shown in FIG. 9C, the winding angle is manually increased so that the position of the winding roller 61 approaches the position of the pressure roller 339.

As described above, when the winding roller 61 is disposed upstream of the pressure roller 339 in the conveyance direction of the recording medium W to bend the conveyance path of the recording medium W, the waviness of the recording medium W due to sagging in conveyance can be reduced before the waviness reaches the coating nip N, thereby suppressing the occurrence of wrinkling.

Third Embodiment

Figure 10:
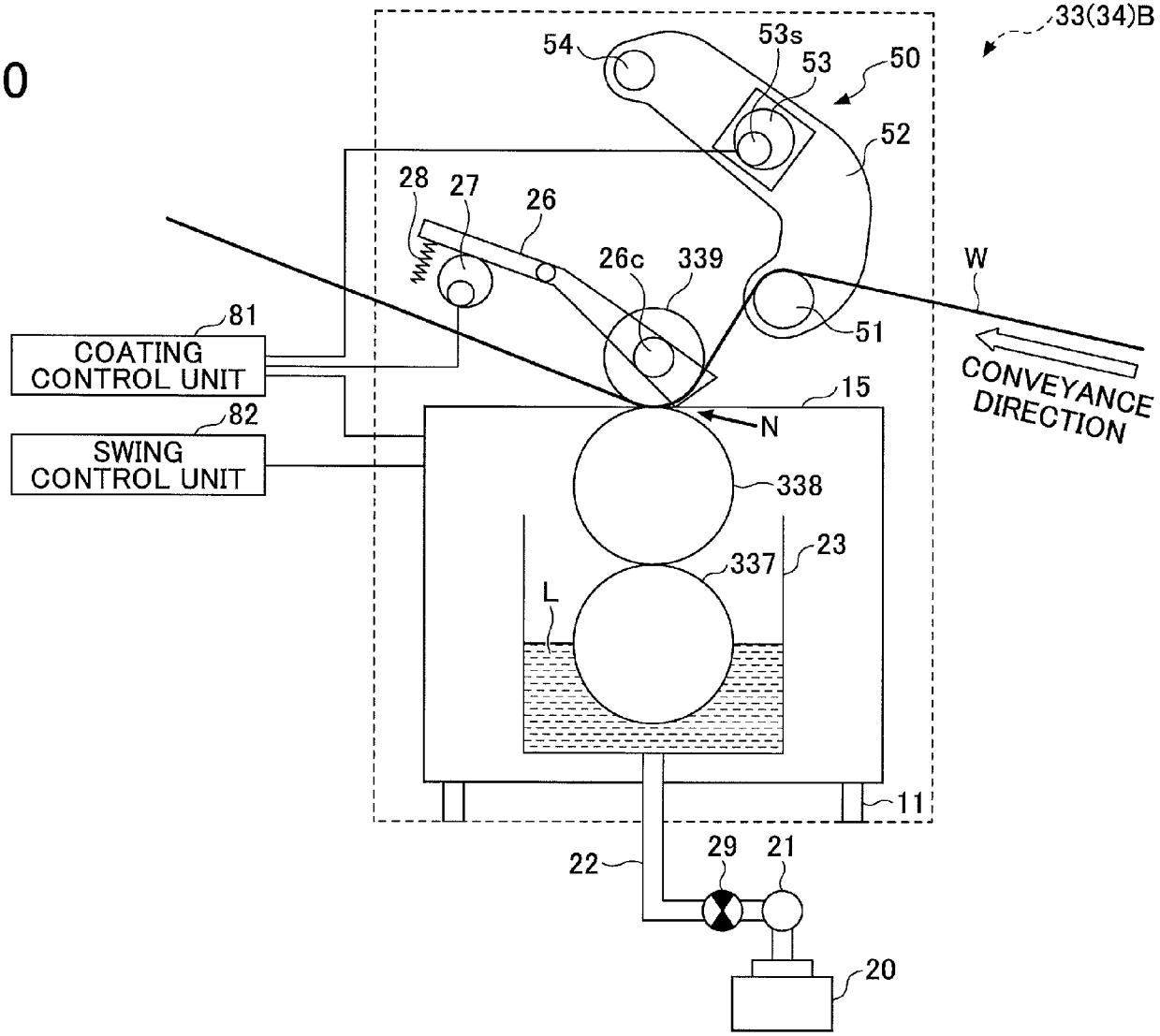
FIG. 10 is a cross sectional view of an example configuration of the coating mechanism of a third embodiment.
Figure 11:
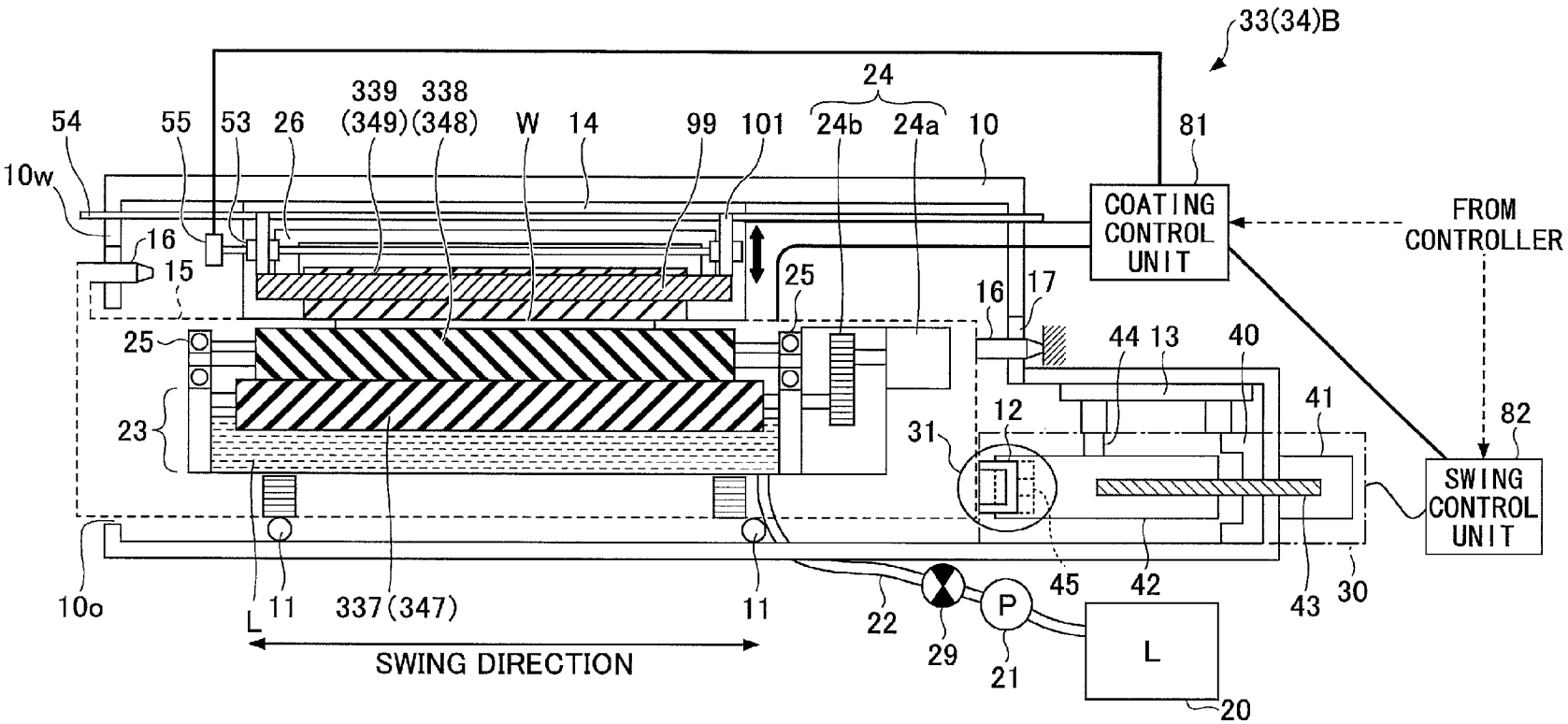
FIG. 11 is a cross sectional view of the example configuration of the coating mechanism shown in FIG. 10 viewed from another direction.

FIG. 10 is a cross sectional view of an example schematic configuration of the coating mechanism 33B of the third embodiment viewed in a roller axis direction. FIG. 11 is a cross sectional view of the example configuration of the coating mechanism 33B shown in FIG. 10 viewed in a direction orthogonal to the roller axis direction.

A configuration of the winding unit 50A of the present embodiment is similar to the configuration thereof shown in the first embodiment. However, the axis 53*s* of the eccentric cam (winding eccentric cam) 53 does not project out from the housing 10, and is coupled to a winding angle adjustment motor (eccentric cam motor) 55, which is different from the first embodiment. Further, the winding angle adjustment motor 55 is coupled to the coating control unit 81.

In the present embodiment, the coating control unit 81, setting a winding amount (angle), controls the winding angle adjustment motor 55 to rotate the eccentric cam 53 and to fix the eccentric cam 53 at an appropriate position, thereby adjusting the winding angle of the recording medium W around the pressure roller 339.

Figure 12:
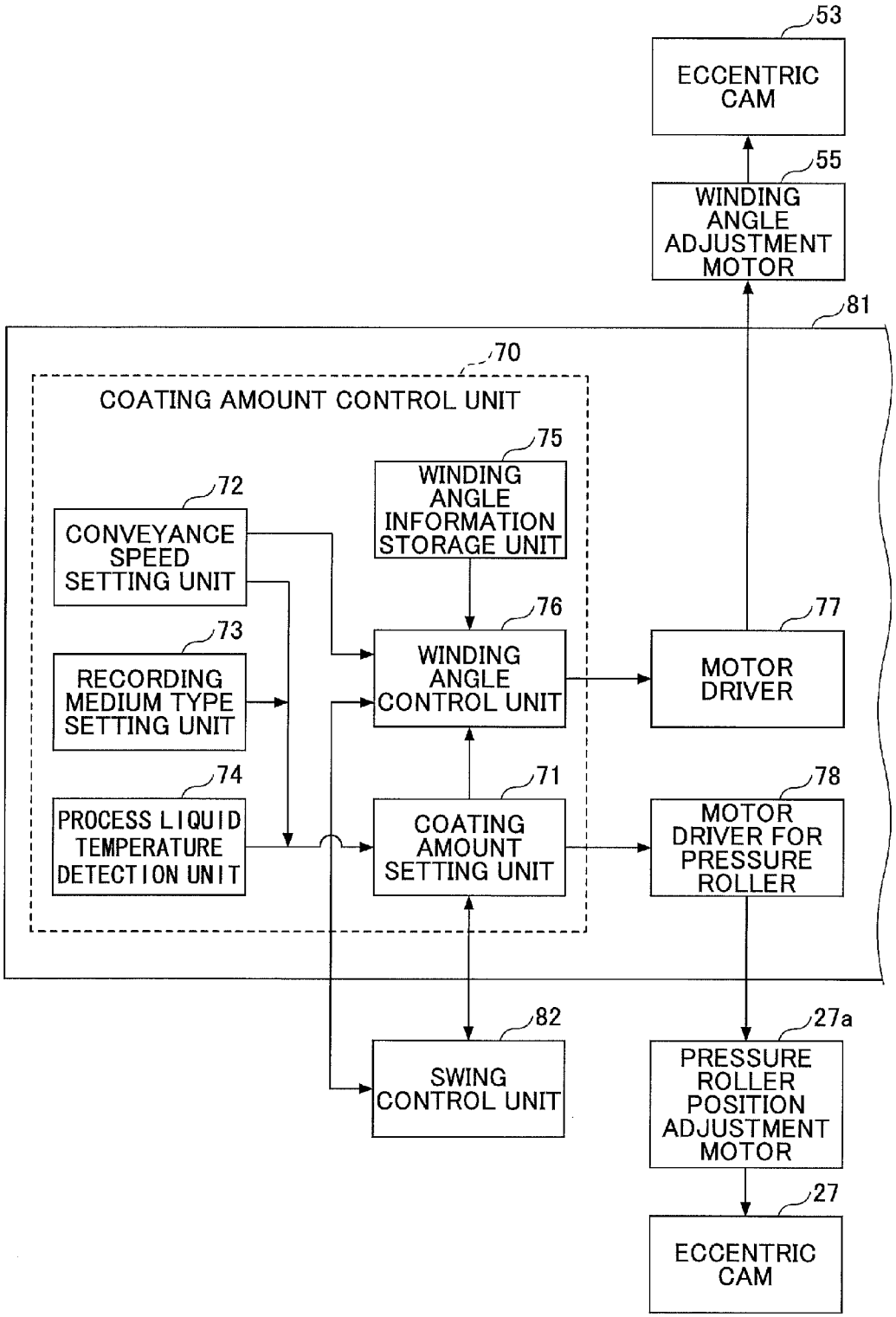
FIG. 12 is a block diagram illustrating a part of a coating control unit related to the present embodiment.

FIG. 12 is a block diagram illustrating a part of the coating control unit 81 related to the present embodiment. The coating control unit 81 includes a coating amount control unit 70 and a motor driver (winding angle adjustment motor driver) 77, where the coating amount control unit 70 determines a moving amount of the winding eccentric cam 53 based on the conveyance speed of the recording medium W, the type of the recording medium W and a temperature of the process liquid L, and the motor driver 77 drives the winding angle adjustment motor 55 based on a signal from the coating amount control unit 70.

The coating amount control unit 70 determines the moving amount (rotation angle) of the winding eccentric cam 53 based on the type of the recording medium W, the conveyance speed of the recording medium W and the temperature of the process liquid L, so that winding angle of the recording medium W around the pressure roller 339 is appropriate. Then, the winding angle adjustment motor 55 is driven by the motor driver 77.

The coating amount control unit 70 includes a coating amount setting unit 71, a conveyance speed setting unit (recording medium conveyance speed setting unit) 72, a recording medium type setting unit 73, a process liquid temperature detection unit 74, a winding angle information storage unit 75 and a winding angle control unit 76.

The conveyance speed setting unit 72 transmits speed setting information of the recording medium W to the coating amount setting unit 71. The recording medium type setting unit 73 transmits type information of the recording medium W to the coating amount setting unit 71. The process liquid temperature detection unit 74 transmits temperature information of the process liquid L detected by a process liquid temperature sensor to the coating amount setting unit 71. The coating amount setting unit 71 determines the coating amount of the process liquid L, and transmits the determined coating amount of the process liquid L to the winding angle control unit 76. The winding angle information storage unit 75 stores a table or a calculation formula in advance. The winding angle information storage unit 75 determines the coating amount of the process liquid L, and transmits the determined coating amount of the process liquid L to the winding angle control unit 76.

A motor driver 78 for the pressure roller is controlled based on the coating amount determined by the coating amount setting unit 71 so as to control the pressure applied to the coating nip N of the pressure roller 339 and the coating roller 338. Thus, a rotation of an eccentric cam (for pressure roller) 27 is controlled through a pressure roller position adjustment motor 27*a*, thereby adjusting the position of the pressure roller 339 in the vertical direction.

Further, the determined coating amount is also transmitted to the swing control unit 82 in order to reflect the determination result in a swing speed. Here, the swing control unit 82 adjusts the swing speed of the coating roller 338 included in the coating unit 15 based on a printing speed (that is, conveyance speed of recording medium W) or coating amount of the process liquid L. Further, the swing control unit 82 may determine whether the swing is intermittently or continuously performed based on the printing speed or the coating amount of the process liquid L. Further, in a case where it is determined that the swing is intermittently performed, intervals between respective operations (periods in which swing operations is suspended) may be determined based on the printing speed or the coating amount of the process liquid L.

As described above, when the coating roller 338 swings with respect to the pressure roller 339 in the coating nip N, the recording medium W may sag in the conveyance due to the swing in a width direction of the recording medium W, and correlation between the swing speed and the sagging of the recording medium W is conceivable.

Therefore, one or more correlation tables or corresponding parameters for setting the correlation between the winding amount and coating amount, conveyance speed and/or swing speed information (including swing speed and information indicating intermittent or continuous swing) are stored in the winding angle information storage unit 75. Further, correlation tables for indicating correlations between the temperature and the coating amount, between the conveyance speed and the coating amount, between the swing speed and the coating amount, etc., may be stored in the winding angle information storage unit 75.

The winding angle control unit 76 determines the winding angle in accordance with the correlation table stored in the winding angle information storage unit 75 based on the coating amount information of the process liquid L determined by the coating amount setting unit 71, the conveyance speed information set by the conveyance speed setting unit 72 and/or the swing speed information set by the swing control unit 82. Alternatively, the winding angle control unit 76 may determine the winding angle in accordance with the values calculated from parameters stored in the winding angle information storage unit 75 based on the coating amount information of the process liquid L, the conveyance speed information and/or the swing speed information.

Also, an operator may directly set, in the coating amount control unit 70, the coating amount information of the process liquid L, the conveyance speed information and the swing speed information through a user interface, etc., and the winding angle control unit 76 may control the winding angle in accordance with the set values.

The winding angle control unit 76 determines the moving amount of the winding eccentric cam 53 in accordance with the determined winding angle to output a signal to the motor driver 77, and thereby controls the coating amount by driving the winding angle adjustment motor 55 to move the winding eccentric cam 53.

Figure 13:
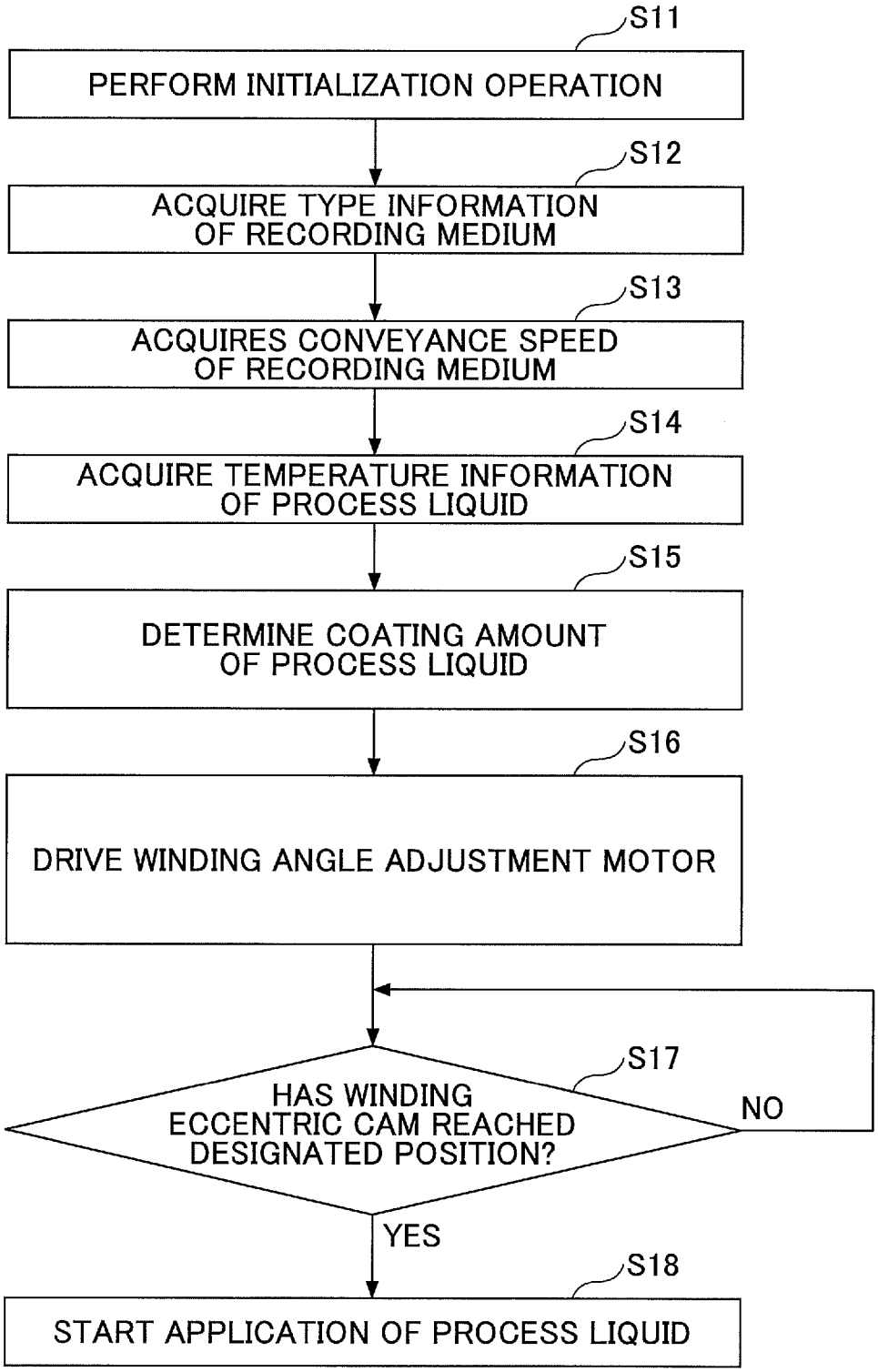
FIG. 13 is a flowchart illustrating control of a winding eccentric cam in starting the coating operation of the process liquid.

FIG. 13 is a flowchart illustrating the control of the winding eccentric cam 53 in starting the coating operation of the process liquid L, showing steps until the start of the coating operation.

The coating amount control unit 70 performs an initialization operation (step S11) to move the winding eccentric cam 53 to a predetermined home position. After the initialization, the recording medium type setting unit 73 acquires type information of the recording medium W (step S12), the conveyance speed setting unit 72 acquires the conveyance speed of the recording medium W (step S13), and the process liquid temperature detection unit 74 acquires the temperature information of the process liquid L from the process liquid temperature sensor 46 (step S14).

The coating amount setting unit 71 determines the coating amount of the process liquid L in accordance with the table or the calculation formula set in advance based on the information acquired in steps S11-S14, and transmits the determined coating amount of the process liquid L to the winding angle control unit 76 (step S15).

The winding angle control unit 76 determines the moving amount of the winding eccentric cam 53 in accordance with the tables stored in the winding angle information storage unit 75 based on the coating amount set in step S15, conveyance speed of the recording medium W set in step S13, and the swing information acquired from the swing control unit 82, to achieve the desired winding angle. The signal is output to the motor driver 77 to drive the winding angle adjustment motor 55 (step S16).

After the winding angle adjustment motor 55 moves the winding eccentric cam 53 to a designated position (step S17), the application of the process liquid to the recording medium W is started, as the printing starts (S18).

Figure 14:
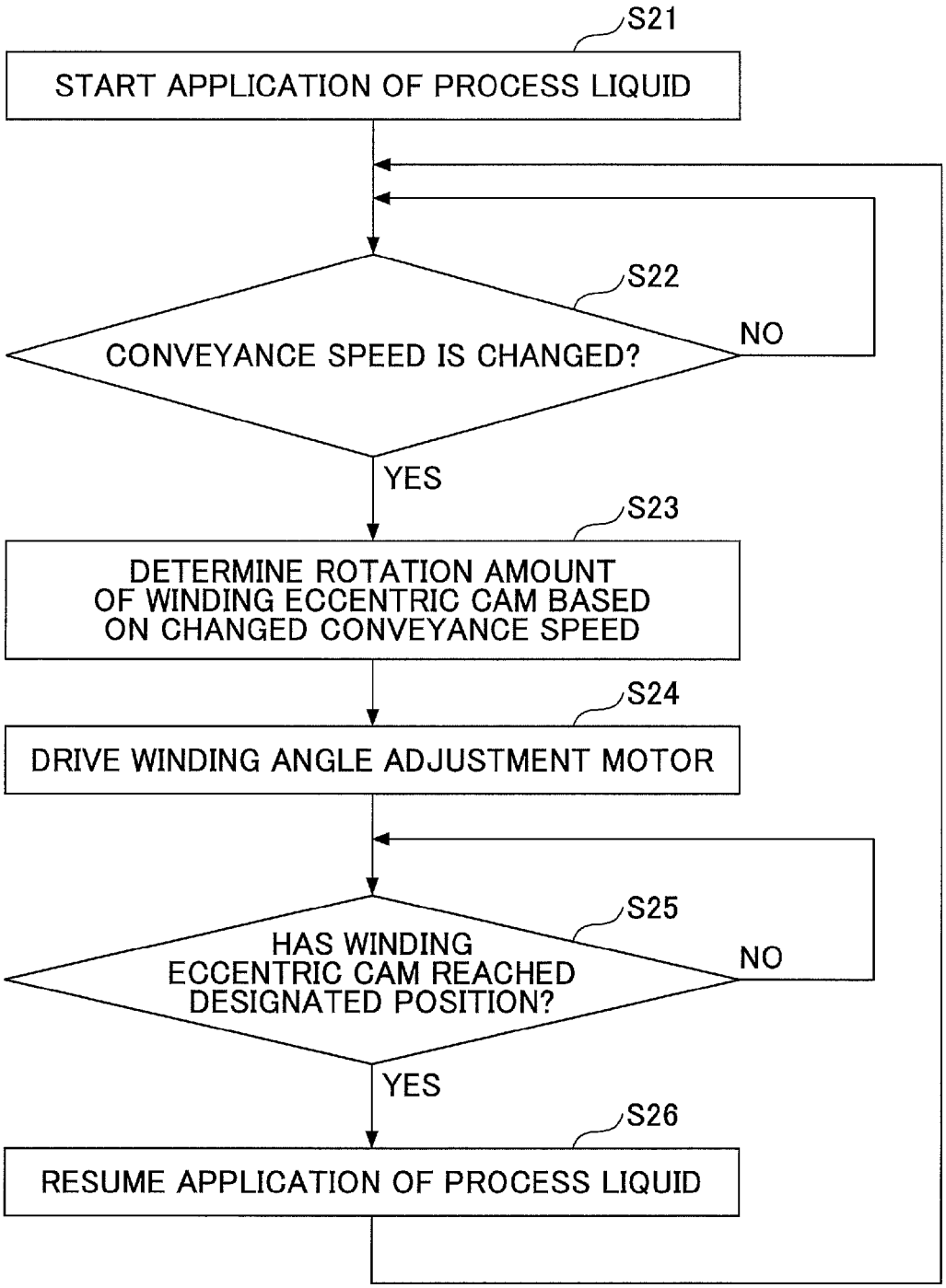
FIG. 14 is a flowchart illustrating control in accordance with change of a printing speed in the coating operation.
Figure 15:
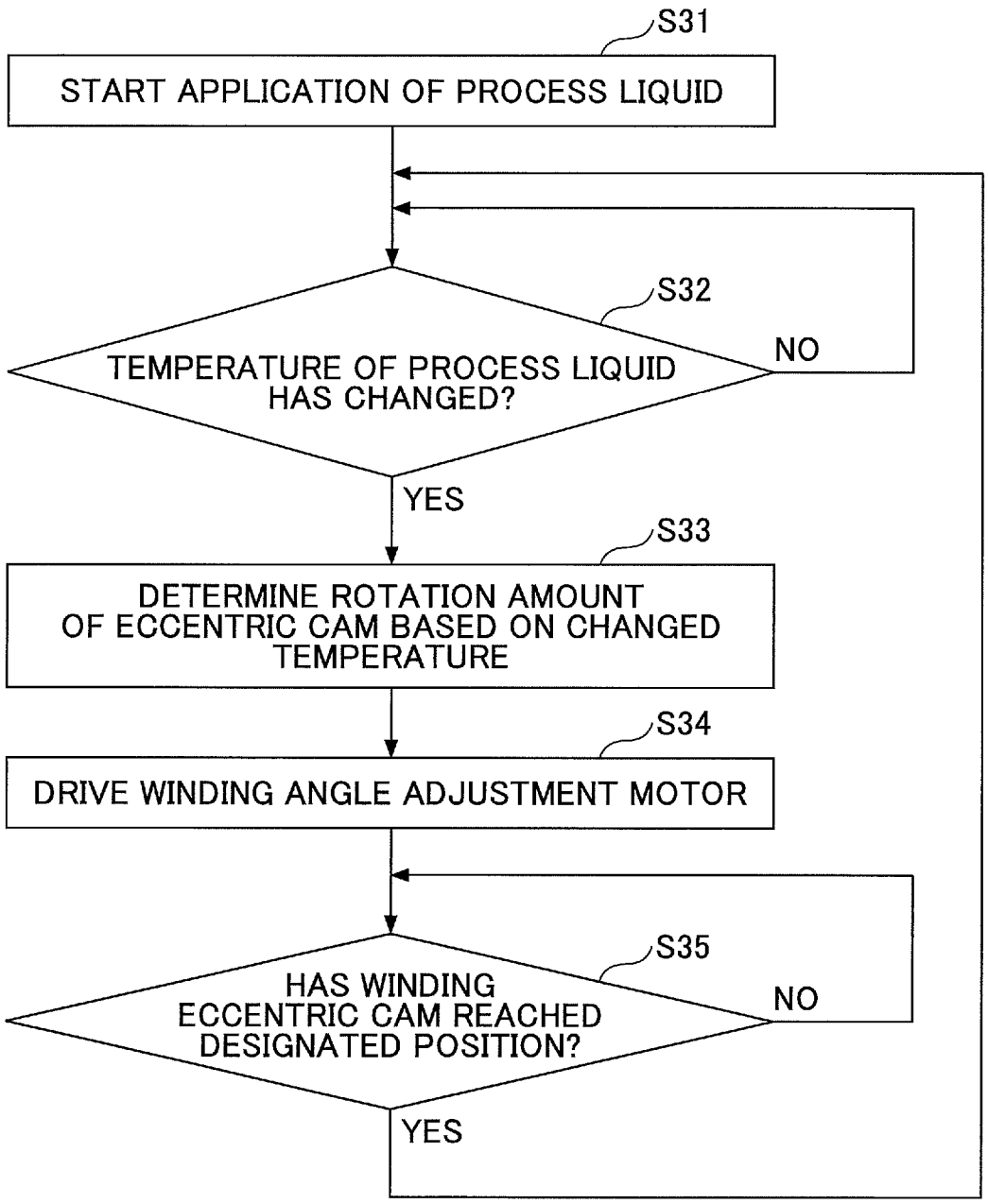
FIG. 15 is a flowchart illustrating control in accordance with change of a temperature of the process liquid in the printing operation.

FIG. 14 and FIG. 15 are flowcharts for illustrating operations after starting application of the process liquid. Among them, FIG. 14 is a flowchart for illustrating control in accordance with change of the printing speed in the coating operation.

After application of the process liquid L is started (step S21), in a case where the conveyance speed setting unit 72 acquires information indicating a change of the conveyance speed of the recording medium W (step S22), the coating amount setting unit 71 determines the coating amount of the process liquid L in accordance with the table or the calculation formula based on the changes in the conveyance speed information that is acquired. Also, the acquired information of the changed conveyance speed is transmitted to the winding angle control unit 76. The winding angle control unit 76 determines the rotation amount of the winding eccentric cam 53 in accordance with the table stored in the winding angle information storage unit 75 based on the coating amount information, the conveyance speed, the swing speed corresponding to the changed conveyance speed/coating amount information (step S23).

Then, the signal corresponding to the determined rotation amount is transmitted to the motor driver 77 to drive the winding angle adjustment motor 55, and the eccentric cam 53 is rotated (step S24).

After the winding angle adjustment motor 55 moves the winding eccentric cam 53 to the designated position (step S25), application of the process liquid L to the recording medium W is started (step S26). According to the aforementioned control, the application of the process liquid L can be continued even if the printing speed is changed.

FIG. 15 is a flowchart for illustrating control in accordance with change of the temperature of the process liquid L in the printing operation. After starting the application of the process liquid L (step S31), in a case where the process liquid temperature detection unit 74 detects a change (e.g., by every 0.5° C.) of the temperature of the process liquid L (step S32) by the process liquid temperature sensor 46, the coating amount setting unit 71 determines the coating amount of the process liquid L in accordance with the table or the calculation formula set in advance based on the detected change of the temperature, and transmits the determined coating amount to the winding angle control unit 76. The winding angle control unit 76 determines the rotation amount of the eccentric cam 53 in accordance with the table stored in the winding angle information storage unit 75 based on the coating amount information set by the coating amount setting unit 71, the conveyance speed, and the swing speed information corresponding to the changed coating amount information (step S33).

Then, the signal is output to the motor driver 77 to drive the winding angle adjustment motor 55 in accordance with the determined rotation amount, thereby moving the winding eccentric cam 53 (step S34).

The winding angle adjustment motor 55 rotates the winding eccentric cam 53 to the designated angle (S35), and the application of the process liquid L to the recording medium W is continued.

According to the aforementioned operation, the coating amount can be corrected in accordance with the table stored in the coating amount setting unit 71 based on the information from the process liquid temperature detection unit 74 even if the temperature of the process liquid L changes, thereby controlling the winding eccentric cam 53 so that the tension corresponding to the corrected coating amount is applied to the recording medium W and the winding angle of the recording medium W around the pressure roller 339 is set corresponding to the corrected coating amount. Hence, the waviness and the wrinkles are reduced in the recording medium W with an appropriate tension applied to the recording medium W.

Additionally, as described in the present embodiment, when the correlation table stored in the winding angle information storage unit 75 indicates correlations between the temperature and the coating amount on 0.5° C.-by-0.5° C. bases, the coating amount setting unit 71 can finely correct the coating amount based on the information from the process liquid temperature detection unit 74.

The winding angle control unit 76 determines the rotation amount of the winding eccentric cam 53 in accordance with the table stored in the winding angle information storage unit 75 based on the coating amount information set by the coating amount setting unit 71, the conveyance speed, and the swing speed information corresponding to the coating amount and the conveyance speed. Then, the signal is output to the motor driver 77 to drive the winding angle adjustment motor 55 in accordance with the determined rotation amount, thereby finely moving (controlling) the winding eccentric cam 53. Therefore, rapid wrinkling of the recording medium can be suppressed by finely controlling the tension applied to the recording medium W and the winding angle of the recording medium W around the pressure roller 339.

As described above, when the winding roller 51 is disposed upstream of the pressure roller 339 in the conveyance direction of the recording medium W to bend the conveyance path of the recording medium W, the waviness of the recording medium W due to sagging in conveyance can be reduced before the waviness reaches the coating nip N, thereby suppressing the occurrence of wrinkling.

Further, in the present embodiment, because the angle of the eccentric cam 53 can be finely adjusted by the winding angle adjustment motor 55, the supporting member 52 can adjust the position of the winding roller 51 with respect to the pressure roller 339 in accordance with the desired coating amount of the process liquid L and the desired tension. Thus, the tension can be finely set, and the occurrence of wrinkling can be appropriately prevented during the coating operation as necessary according to the situation.

Fourth Embodiment

Figure 16:
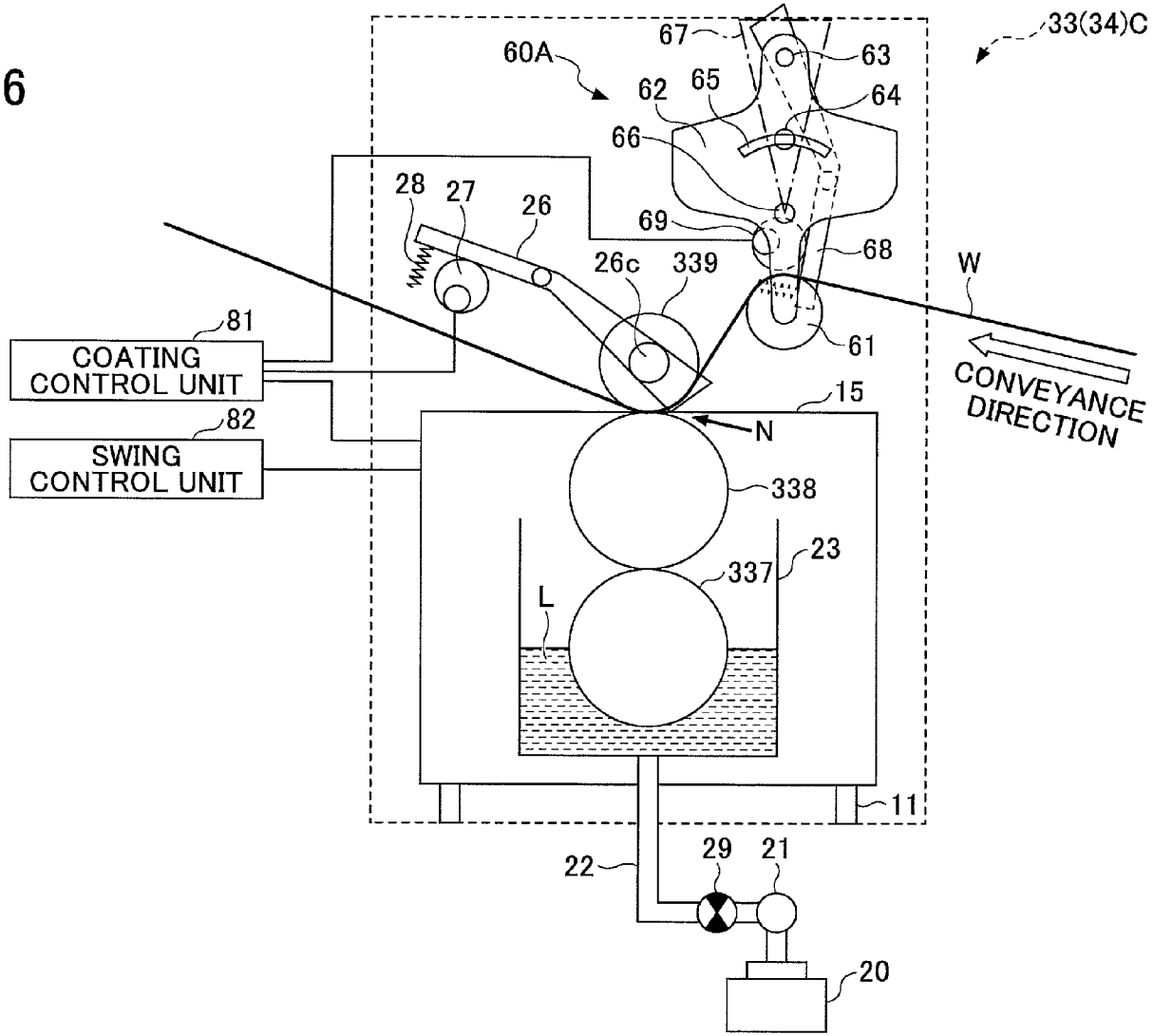
FIG. 16 is a cross sectional view of an example configuration of the coating mechanism of a fourth embodiment.
Figure 17:
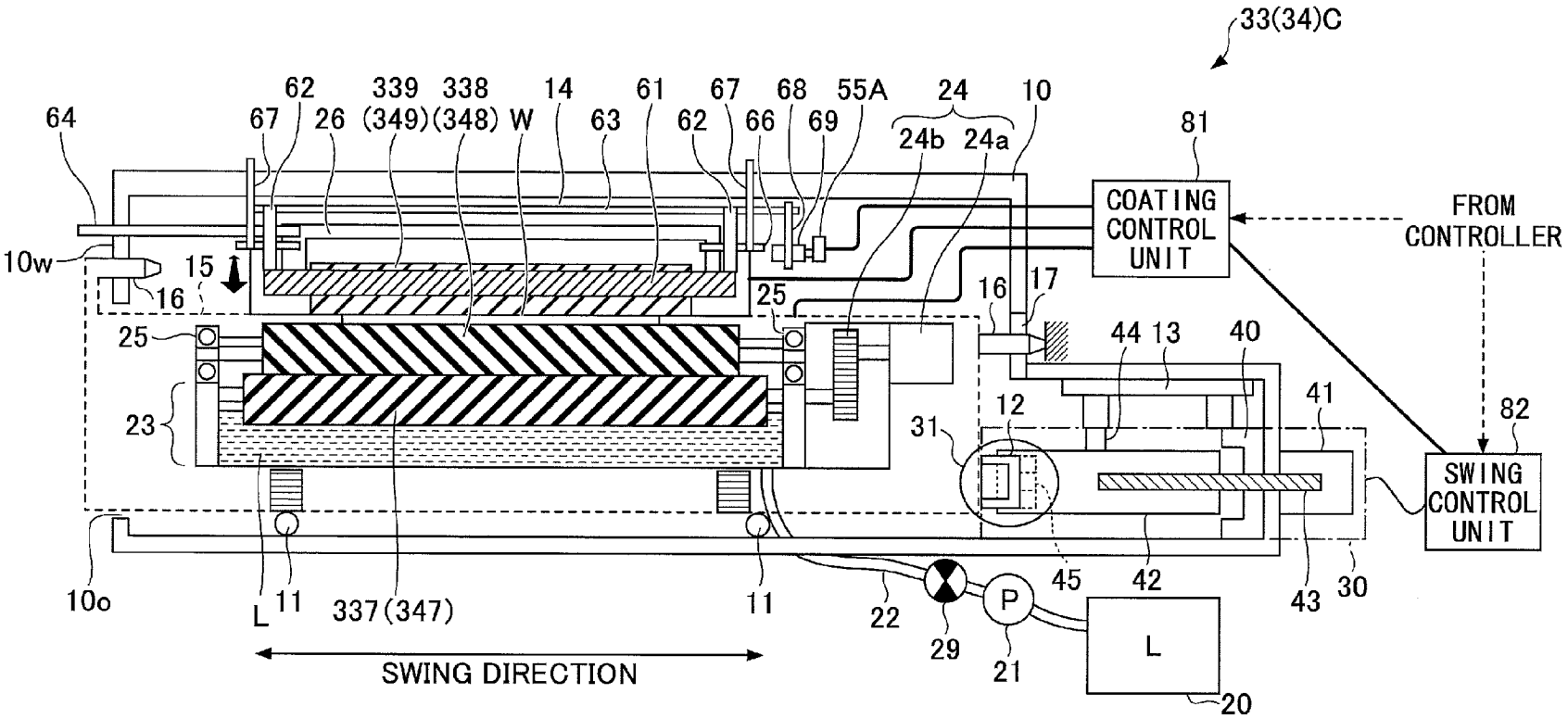
FIG. 17 is a cross sectional view of the example configuration of the coating mechanism shown in FIG. 16 viewed from another direction.

FIG. 16 is a cross sectional view of an example configuration of the coating mechanism 33C of the fourth embodiment viewed in a roller axis direction. FIG. 17 is a cross sectional view of the example configuration of the coating mechanism 33C shown in FIG. 16 viewed in a direction orthogonal to the roller axis direction.

Although a configuration of the winding unit 60A of the present embodiment is almost the same as the configuration of the first embodiment, the axis 63 does not project from the wall 10*w* of the housing 10, while the axis 63 is coupled to the eccentric cam (winding eccentric cam) 69 through the arm unit 68. Further, the present embodiment differs from the first embodiment in that the eccentric cam 69 is coupled to the winding angle adjustment motor (eccentric cam motor) 55A, and the winding angle adjustment motor 55A is coupled to the coating control unit 81.

In the present embodiment, the coating control unit 81, setting the winding amount (angle), controls the winding angle adjustment motor 55A to rotate the eccentric cam 69, thereby adjusting the winding angle by horizontally (in left and right direction) moving the position of the winding roller 61 and fixing it at an appropriate position.

The winding angle adjustment motor 55A is controlled in a manner similar to that described in the third embodiment, and in the present embodiment, the coating control unit 81 can perform the control shown in FIG. 13-FIG. 15.

As described above, when the winding roller 61 is disposed upstream of the pressure roller 339 in the conveyance direction of the recording medium W to bend the conveyance path of the recording medium W, the waviness of the recording medium W due to sagging during conveyance can be reduced before the waviness reaches the coating nip N, thereby suppressing wrinkling of the recording medium W.

Further, in the present embodiment, because the angle of the eccentric cam 69 can be finely adjusted by the winding angle adjustment motor 55A, the supporting member 62 can adjust the position of the winding roller 61 with respect to the pressure roller 339 in accordance with the desired coating amount of the process liquid L and the desired tension. Thus, the tension can be finely set, and the occurrence of wrinkling can be appropriately prevented during the coating operation as necessary according to the situation.

Fifth Embodiment

Figure 18:
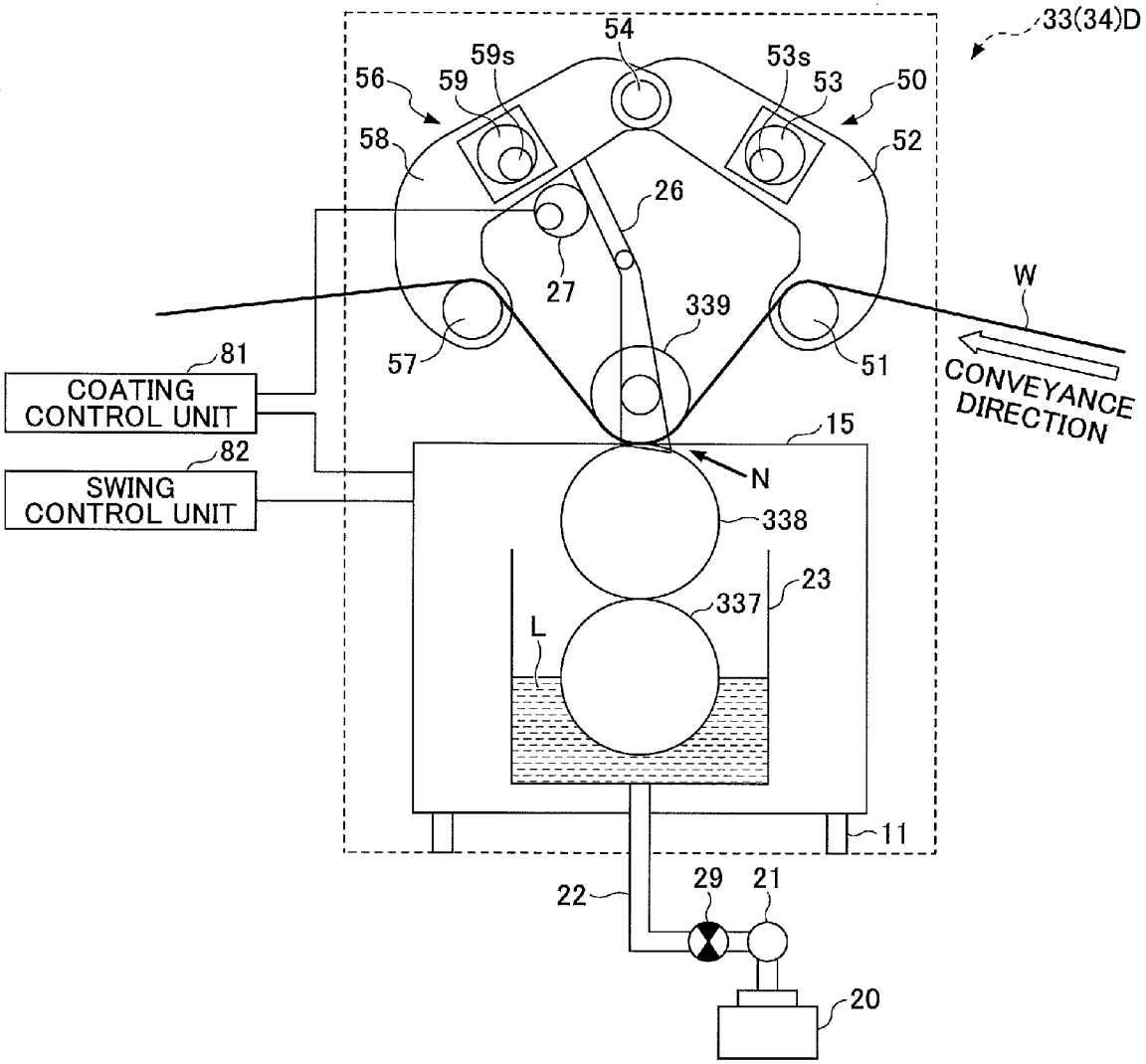
FIG. 18 is a cross sectional view of an example configuration of the coating mechanism of a fifth embodiment.
Figure 19:
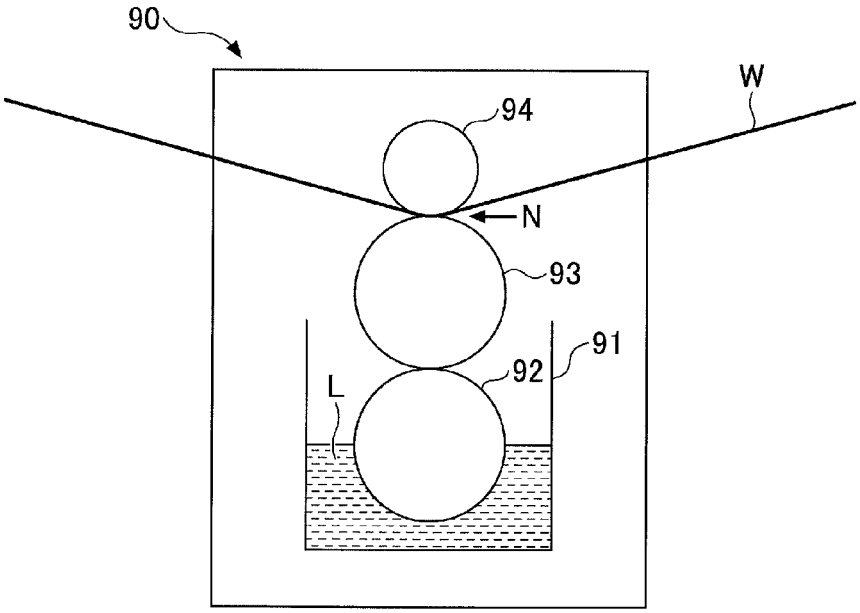
FIG. 19 is a diagram schematically illustrating an example conventional process liquid coating unit.

FIG. 18 is a cross sectional view for schematically illustrating an example configuration of the coating mechanism 33D of the fifth embodiment viewed in a roller axis direction. The present configuration is characterized by disposing an upstream winding roller 51 upstream of the pressure roller 339 and disposing a downstream winding roller 57 downstream of the pressure roller 339. Similarly to the first embodiment, the winding unit 56 is disposed in which the winding roller 57 is fixed at supporting member 58 in which the pivot 54 and the eccentric cam (winding eccentric cam) 59 is formed.

When disposing the winding rollers 51 and 57 respectively at upstream side and downstream side of the pressure roller 339, the winding angle θ of the conveyed recording medium W around the pressure roller 339 can be set greater than the winding angles of the first to fourth embodiments. For example, the winding angle shown in FIG. 18 is approximate 165°.

As shown in FIG. 6, as the winding angle increases, the occurrence of the wrinkles can be more suppressed because the unevenness of the sheet is be reduced. That is, according to the fifth embodiment, the wrinkling of the recording medium W can be suppressed even in a case where the recording medium W is roll of paper likely to include the wrinkles in comparison to the case of the first embodiment to the fourth embodiment or the recording medium W kept in a condition likely to cause the wrinkling (e.g., high humidity absorption property, high humidity environment) in comparison to the case of the first embodiment to the fourth embodiment.

However, in the fifth embodiment, because a surface of the recording medium W on which the process liquid L is coated is in contact with the winding roller 57 downstream of the coating nip N of the pressure roller 339, coating irregularities may occur. Therefore, preferably, the winding angle is set as low as possible downstream in the conveyance direction to make the area small, in which the winding roller 57 contacts the surface of the recording medium W.

Hence, in the fifth embodiment shown in FIG. 18, preferably, the winding angle is set to be greater at the upstream side of the coating nip N than at the downstream side thereof. In order to adjust the winding angle to a desired angle by using the two winding rollers, the winding rollers 51 and 57 may be disposed at fixed positions as described in the first embodiment, or the positions of the winding rollers 51 and 57 may be adjusted as necessary as described in the third embodiment.

Also, two winding units 60 as described in the second embodiment may be disposed at the upstream side and the downstream side of the coating nip N. In this case, the winding units 60 may be disposed at fixed positions or the positions thereof may be adjusted as necessary.

As described above, when the winding roller 51 is disposed upstream of the pressure roller 339 in the conveyance direction of the recording medium W to bend the conveyance path of the recording medium W, the waviness of the recording medium W due to sagging in conveyance can be reduced before the waviness reaches the coating nip N, thereby suppressing the occurrence of the wrinkles.

Additionally, in the fifth embodiment, although the winding units 50 as described in the first embodiment are disposed at upstream side and downstream side of the pressure roller 339, the winding units 60 as described in the second embodiment may be disposed at upstream side and downstream side of the pressure roller 339. In this case, preferably, the winding angle is set to be higher at the upstream side of the coating nip N than at the downstream side thereof by disposing the two winding units 60 or adjusting the positions of the two winding units 60.

Although the descriptions are given above, in which the winding rollers 51, 61 and 57 are applied to the back surface coating mechanism 33 shown in FIG. 2, a similar effect can be obtained when the winding rollers 51, 61 and 57 are applied to the front surface coating mechanism 34.

Additionally, in the descriptions given above, the winding rollers 51, 61 and 57 are applied to the coating mechanisms 33 and 34 configured to swing the coating unit 15 so as to prevent abrasion caused by contacting the coating roller 338 and the pressure roller 339 with edge portion of the recording medium W. However, the occurrence of the wrinkles can be similarly prevented when the winding rollers 51, 61 and 57 are applied to the coating mechanisms which do not swing the coating unit.

In the descriptions given above, although the process liquid is the pretreatment liquid, the process liquid may be after-treatment liquid.

Although the invention has been described with respect to example embodiments for a complete and clear disclosure, the appended claims are not to be limited to the described embodiments but are to be construed as embodying all modifications and alternative constructions that may occur to one skilled in the art that fairly fall within the basic teaching set forth herein. The present application is based on Japanese Priority Application No. 2015-049941 filed on Mar. 12, 2015, the entire contents of which are hereby incorporated herein by reference.

What is claimed is:

1. A process liquid coating apparatus comprising:

a recording medium conveyance unit configured to convey a recording medium;

a coating roller configured to rotate in accordance with the conveyed recording medium to apply process liquid on a surface of the recording medium;

a pressure roller configured to cause the coating roller to apply the process liquid on the surface of the recording medium by forming an abutment part for nipping and pressing the recording medium with the coating roller; and a winding member configured to form a bent conveyance path along which the recording medium is bent with respect to a conveyance direction so that the recording medium is wound around the surface of the pressure roller, wherein the winding member is disposed adjacent to the pressure roller, wherein the winding member is disposed at an upstream side of the pressure roller in the conveyance direction of the recording medium to bend the recording medium before the conveyed recording medium contacts the pressure roller wherein the processing liquid coating apparatus further comprises a swing unit configured to swing a position of the coating roller with respect to the pressure roller and the winding member in a width direction of the recording medium during a process liquid coating operation.

2. The process liquid coating apparatus as claimed in claim 1, wherein another winding member is disposed at a downstream side of the pressure roller, in the conveyance direction of the recording medium, to bend the recording medium after the recording medium contacts the pressure roller.

3. The process liquid coating apparatus as claimed in claim 2, wherein the winding members are disposed, or the positions of the winding members are adjusted, so that the winding angle at which the recording medium is wound around the surface of the pressure roller is greater at the upstream side than at the downstream side.

4. The process liquid coating apparatus as claimed in claim 1, wherein the winding member is disposed, or the position of the winding member is adjusted, so that the winding angle at which the recording medium is wound around the surface of the pressure roller is greater than or equal to 45 degrees.

5. A process liquid coating apparatus comprising:

a recording medium conveyance unit configured to convey a recording medium;

a coating roller configured to rotate in accordance with the conveyed recording medium to apply process liquid on a surface of the recording medium;

a pressure roller configured to cause the coating roller to apply the process liquid on the surface of the recording medium by forming an abutment part for nipping and pressing the recording medium with the coating roller; and a winding member configured to form a bent conveyance path along which the recording medium is bent with respect to a conveyance direction so that the recording medium is wound around the surface of the pressure roller, wherein the winding member is disposed adjacent to the pressure roller, wherein the winding member is supported by a supporting member, and the supporting member allows adjustment of a position of the winding member with respect to the pressure roller, thereby facilitating adjust of a winding angle at which the recording medium is wound around the surface of the pressure roller wherein the processing liquid coating apparatus further comprises a swing unit configured to swing a position of the coating roller with respect to the pressure roller and the winding member in a width direction of the recording medium during a process liquid coating operation.

6. The process liquid coating apparatus as claimed in claim 5, wherein the supporting member adjusts the position of the winding member so that the winding member separates from the pressure roller when the recording medium is charged.

7. The process liquid coating apparatus as claimed in claim 5, wherein the supporting member adjusts the position of the winding member with respect to the pressure roller in accordance with at least one of a desired coating amount of the process liquid, a conveyance speed of the recording medium, and a swing speed of the swing unit.

8. An image forming system comprising:

a conveyance unit configured to convey the recording medium;

a recording apparatus configured to eject ink to the recording medium to adhere the ink on a surface of the recording medium; and a coating apparatus disposed at an upstream side of the recording apparatus in a conveyance direction of the recording medium; wherein the coating apparatus comprises:

a recording medium conveyance unit configured to convey a recording medium;

a coating roller configured to rotate in accordance with the conveyed recording medium to apply process liquid on a surface of the recording medium;

a pressure roller configured to cause the coating roller to apply the process liquid on the surface of the recording medium by forming an abutment part for nipping and pressing the recording medium with the coating roller; and a winding member configured to form a bent conveyance path along which the recording medium is bent with respect to the conveyance direction so that the recording medium is wound around surface of the pressure roller, wherein the winding member is disposed adjacent to the pressure roller, wherein the winding member is disposed at an upstream side of the pressure roller in the conveyance direction of the recording medium to bend the recording medium before the conveyed recording medium contacts the pressure roller wherein the coating apparatus further comprises a swing unit configured to swing a position of the coating roller with respect to the pressure roller and the winding member in a width direction of the recording medium during a process liquid coating operation.

* * * * *